US008311236B2

(12) United States Patent
Kanamori

(10) Patent No.: US 8,311,236 B2
(45) Date of Patent: Nov. 13, 2012

(54) NOISE EXTRACTION DEVICE USING MICROPHONE

(75) Inventor: Takeo Kanamori, Osaka (JP)

(73) Assignee: Panasonic Corporation, Osaka (JP)

( * ) Notice: Subject to any disclaimer, the term of this patent is extended or adjusted under 35 U.S.C. 154(b) by 809 days.

(21) Appl. No.: 12/517,406

(22) PCT Filed: Oct. 3, 2008

(86) PCT No.: PCT/JP2008/002797
§ 371 (c)(1),
(2), (4) Date: Jun. 3, 2009

(87) PCT Pub. No.: WO2009/044562

PCT Pub. Date: Apr. 9, 2009

(65) Prior Publication Data

US 2010/0026858 A1 Feb. 4, 2010

(30) Foreign Application Priority Data

Oct. 4, 2007 (JP) ..... 2007-260693

(51) Int. Cl.
*H04R 3/00* (2006.01)

(52) U.S. Cl. ..... 381/92; 381/94.1; 381/94.2; 381/94.7; 381/71.1; 381/71.3; 381/122; 348/231.4; 348/207.99

(58) Field of Classification Search ..... 381/92, 381/94.1, 94.2, 94.3, 94.7, 71.1, 71.3, 122; 704/200.1, 226; 348/231.4, 423.1, 207.99
See application file for complete search history.

(56) References Cited

U.S. PATENT DOCUMENTS 5,917,921 A 6/1999 Sasaki et al.
2003/0161484 A1* 8/2003 Kanamori et al. ..... 381/71.7
2005/0060142 A1 3/2005 Visser et al.
2005/0234715 A1 10/2005 Ozawa
2006/0053002 A1 3/2006 Visser et al.
2007/0038442 A1 2/2007 Visser et al.
2007/0150261 A1 6/2007 Ozawa

FOREIGN PATENT DOCUMENTS

JP 56-025892 3/1981
JP 5-066255 3/1993
JP 8-065789 3/1996

(Continued)

OTHER PUBLICATIONS

Machine translation of JP 2002-171586, Jun. 2002.

(Continued)

*Primary Examiner* — Vivian Chin
*Assistant Examiner* — Paul Kim
(74) *Attorney, Agent, or Firm* — Wenderoth, Lind & Ponack, L.L.P.

(57) ABSTRACT

A noise extraction device of the present invention includes: first and second microphone units (11 and 12) each picking up a sound; a directivity synthesis unit which performs a directivity synthesis on output signals respectively received from the first and second microphone units (11 and 12) and generates two directionally synthesized signals which have: different sensitivities to noise; the same directional pattern with respect to sound pressure; and the same effective acoustic center position; and an acoustic cancellation unit which cancels an acoustic component of one of the two directionally synthesized signals by subtracting the one of the two directionally synthesized signals from the other of the two directionally synthesized signal, so as to extract a noise component.

16 Claims, 9 Drawing Sheets

FOREIGN PATENT DOCUMENTS

| | | | |
|---|---|---|---|
| JP | 3279612 | | 2/2002 |
| JP | 3283423 | | 3/2002 |
| JP | 2002-171586 | | 6/2002 |
| JP | 2002-171591 | | 6/2002 |
| JP | 2002171586 A | * | 6/2002 |
| JP | 2002-223493 | | 8/2002 |
| JP | 2002-374588 | | 12/2002 |
| JP | 2003-304586 | | 10/2003 |
| JP | 2004-201033 | | 7/2004 |
| JP | 2005-303681 | | 10/2005 |
| JP | 2006-510069 | | 3/2006 |
| JP | 2007-150737 | | 6/2007 |
| JP | 2007-158516 | | 6/2007 |
| WO | 2004/053839 | | 6/2004 |

OTHER PUBLICATIONS

International Search Report issued Dec. 22, 2008 in the International (PCT) Application of which the present application is the U.S. National Stage.

* cited by examiner

FIG. 2

| | Signal | Directivity | Sensitivity to sound wave | Signal waveform |
|---|---|---|---|---|
| (i) | Output signal xm0 from first directivity synthesis unit 20 | Omnidirectional (Directional in higher domains because of additive synthesis) | Sound pressure sensitivity: high | Sound wave, Vibration noise |
| (ii) | Output signal xm1 from second directivity synthesis unit 30 | Unidirectional (Principal axis direction : 0° ) | Sound pressure sensitivity: low | |
| (iii) | Output signal xm2 from third directivity synthesis unit 40 | Unidirectional (Principal axis direction : 180° ) | Sound pressure sensitivity: low | |
| (iv) | Output signal nv1 from signal cancellation calculation unit 80 $nv1 = \lvert xm1 \rvert + \lvert xm2 \rvert - \lvert xm0 \rvert$ | — | Sound pressure sensitivity: none | Vibration noise |

NOISE EXTRACTION DEVICE USING MICROPHONE

TECHNICAL FIELD

The present invention relates to a noise extraction device, and particularly to a noise extraction device which uses microphones and extracts vibration noise of a microphone device that obtains outputs by processing signals received from two or more microphone units.

BACKGROUND ART

As signal processing performed by a microphone device which obtains outputs by processing signals received from two or more microphone units, there is a directivity synthesis method of a sound-pressure gradient type, for example. While the directivity synthesis method has an advantage that directivity can be formed on a small scale, the method has a disadvantage that the sensitivity to sound pressure is reduced when the directivity synthesis is performed. This is to say, according to the directivity synthesis method, although the directivity can be formed, the sensitivity to sound pressure is reduced with respect to a noise level of vibration noise caused in the microphone units. With this being the situation, when the directivity synthesis method is employed, the problem associated with vibration noise relatively becomes serious.

Conventional measures against vibration noise of microphones include: 1) Floating; 2) Cancelling using a vibration sensor; and 3) Cancelling using signals of microphone units. In the following, an explanation is given as to 2) Cancelling using a vibration sensor, which is closely related to the present invention as a method to address the problem of vibration noise.

FIG. 10 is a diagram for explaining a conventional method for addressing vibration noise. A microphone device 800 shown in FIG. 10 includes a microphone unit 1, a microphone unit 2 whose sound hole is sealed, a housing 3 which holds the microphone unit 1 and the microphone unit 2, and a signal subtraction unit 4 which receives an output signal from the microphone unit 1 and an output signal from the microphone 2 and performs subtraction of the received signals.

Next, an explanation is given as to an operation relating to processing performed to address vibration noise by the microphone device 800 configured as described so far.

The microphone unit 1 is set mainly for picking up a target sound wave, and provides an output signal of the picked-up target sound wave. Practically speaking, however, a diaphragm of the microphone unit 1 is vibrated by vibration caused by a factor other than the target sound wave. The vibration noise caused by this vibration is superimposed on the signal of the target sound wave to be picked up, and then an output of this superimposed signal is provided by the microphone unit 1.

In order to cancel this vibration noise, the microphone unit 2 is set as shown in FIG. 10. The sound hole of the microphone unit 2 is sealed in order for the sensitivity to sound waves to be reduced sufficiently, so that the microphone unit 2 operates as a vibration sensor. The microphone unit 2 is fixed in the housing 3 where the microphone 1 is fixed as well. With this configuration, the vibration caused by a factor other than the target sound wave would occur to the microphone 1 and the microphone 2 in the same way as much as possible.

In this way, the microphone unit 2 picks up the vibration noise, which also occurs to the microphone unit 1 and is caused by vibration resulting from a factor other than the target sound wave.

Thus, a vibration noise component of the output signal from the microphone unit 2 is considered to be the same as that of the output signal from the microphone unit 1. Also, through the subtraction processing performed by the signal subtraction unit 4, the vibration component superimposed on the output signal of the microphone unit 1 can be cancelled.

Accordingly, from the signal subtraction unit 4, the microphone device 800 can obtain the output of the sound wave signal which the microphone device 800 wishes to pick up.

Patent Reference 1: Japanese Unexamined Patent Application Publication No. 56-25892

DISCLOSURE OF INVENTION

Problems that Invention is to Solve

In the case of the conventional configuration described above, however, although the microphone unit 1 and the microphone 2 are fixed in the same housing 3, the vibration noise signals provided by the two microphone units are not the same. To be more specific, when the above-described conventional configuration is employed, the output vibration noise signals provided by the two microphone units are not the same not only because the same vibration is not practically transmitted to the two microphone unit but also because the individual variability in the level of vibration sensitivity is present between the microphone unit 1 and the microphone unit 2. For this reason, it is difficult for the signal subtraction unit 4 to cancel the vibration component superimposed on the output signal of the microphone unit 1 and, thus, the full effectiveness cannot be ensured. In other words, the microphone device 800 ends up obtaining, from the signal subtraction unit 4, the signal which includes the vibration noise aside from the sound wave picked up by the microphone device 800.

Moreover, in the case of the above-described conventional configuration, separately from the microphone unit 1 for picking up the target sound wave, the vibration sensor (the microphone unit 2, in this case) needs to be set to cancel the vibration component. This adds constraints to implementation.

The present invention is conceived in view of the stated problems, and an object of the present invention is to provide a noise extraction device which extracts noise without newly adding a vibration sensor to a microphone device that picks up a sound wave.

Means to Solve the Problems

To achieve the stated object, the noise extraction device of the present invention includes: first and second microphone units which each pick up a sound; a directivity synthesis unit which performs a directivity synthesis on output signals respectively received from the first and second microphone units, and generates two directionally synthesized signals which have: different sensitivities to noise; the same directional pattern with respect to sound pressure; and the same effective acoustic center position; and an acoustic cancellation unit which cancels an acoustic component of one of the two directionally synthesized signals by subtracting the one of the two directionally synthesized signals from the other of the two directionally synthesized signals, so as to extract a noise component.

Here, the directivity synthesis unit may include: first, second, and third directivity synthesis units which each perform the directivity synthesis on the output signals respectively received from the first and second microphone units; and first, second, and third signal absolute value units which respectively calculate absolute values of output signals received from the first, second, and third directivity synthesis units and respectively provide outputs of absolute value signals, and the acoustic cancellation unit may include a cancellation calculation unit which obtains the absolute value signal provided by the first signal absolute value unit as the one of the two directionally synthesized signals, generates the other of the two directionally synthesized signals using the absolute value signals respectively provided by the second and third signal absolute value units, and cancels the acoustic component by subtracting the other of the two directionally synthesized signals from the one of the two directionally synthesized signals.

Also, as compared to the first directivity synthesis unit, each of the second and third directivity synthesis units may have one of: a high sensitivity to the noise component; and a low sensitivity to the acoustic component.

Moreover, the second and third directivity synthesis units may respectively perform the directivity syntheses so that directional patterns of the output signals of the second and third directivity synthesis units become opposite in direction to each other, according to a directivity synthesis method of a sound-pressure gradient type, and a sum of the directional patterns of the output signals respectively from the second and third directivity synthesis units may be equivalent to a directional pattern of the output signal from the first directivity synthesis unit.

Furthermore, the first directivity synthesis unit may perform the directivity synthesis of an addition type by adding the output signals from the first and second microphone units together, the second directivity synthesis unit may perform the directivity synthesis of a sound-pressure gradient type by causing a predetermined delay to the output signal of the second microphone unit and subtracting the delayed output signal from the output signal of the first microphone unit, and the third directivity synthesis unit may perform the directivity synthesis of the sound-pressure gradient type by causing a predetermined delay to the output signal of the first microphone unit and subtracting the delayed output signal from the output signal of the second microphone unit.

Also, the noise extraction device may further include first, second, and third signal band limitation units which respectively limit signal bands of the output signals from the first, second, and third directivity synthesis units, and provide the output signals to the first, second, and third signal absolute value units respectively.

Moreover, the acoustic cancellation unit may provide an output signal showing the extracted noise component, and the noise extraction device may further include a signal reconstruction unit which reconstructs a noise waveform signal using the output signal from the acoustic cancellation unit and the output signal from one of the first, second, and third directivity synthesis units, and provides an output of the reconstructed noise waveform signal.

Furthermore, the signal reconstruction unit may reconstruct the noise waveform signal by multiplying the output signal from the cancellation calculation unit by a sign of the output signal from one of the first, second, and third directivity synthesis units.

Also, the noise extraction device may further include time-frequency transformation units which perform a transformation from a time domain to a frequency domain, the time-frequency transformation units being respectively located in front of or behind the first, second, and third directivity synthesis units, wherein the cancellation calculation unit may extract the noise component for each frequency.

Moreover, the noise extraction device may further include a signal reconstruction unit which reconstructs a noise waveform signal using the output signal from the cancellation calculation unit and the output signal from one of the first, second, and third directivity synthesis units, and provides an output of the reconstructed noise waveform signal, wherein the signal reconstruction unit may reconstruct the noise waveform signal using phase information for each frequency of the output signal from one of the first, second, and third directivity synthesis units and amplitude information for each frequency of the output signal from the cancellation calculation unit.

Furthermore, the noise extraction device may be a vibration sensor.

Also, the noise extraction device may extract the acoustic component from the one of the two directionally synthesized signals.

It should be noted that the present invention can be realized not only as a device, but also as: an integrated circuit which includes the processing units included in such a device; a method which includes the processing units included in the device as steps; and a program which causes a computer to execute these steps.

Effects of the Invention

The present invention can realize a noise extraction device which extracts noise without newly adding a vibration sensor to a microphone device that picks up a sound wave.

Thus, it becomes possible to realize a device which precisely extracts vibration noise entering into the microphone device that obtains the output signals through the signal synthesis from two or more microphone units.

More specifically, the present invention employs a configuration whereby vibration noise is extracted from the microphone units themselves which are used for obtaining the output signal of the sound wave that the microphone device wishes to pick up. There is a high degree of correlation between the extracted vibration noise and the vibration noise entering into the microphone device. Using this extracted vibration noise, the noise at the position of the microphone unit (the vibration noise entering into the microphone device) can be suppressed or controlled with precision.

Also, according to the extraction method of the present invention for extracting the vibration noise included in the microphone unit, a sound wave from every direction is cancelled all the time using the directionally-synthesized outputs which are different in vibration sensitivity, so that only the vibration noise is extracted. Accordingly, without the influence of intensity of the sound wave, an accurate level of the vibration noise can be detected and a vibration noise waveform can be thus estimated.

It should be noted that the present invention provides a method for cancelling a picked-up signal of a sound wave and extracting only noise. Therefore, the same effect can be achieved in the case of, for example, wind noise which is different in signal behavior from the sound wave and similar in property to the vibration noise. Here, the wind noise refers to noise caused when the microphone is buffeted by wind.

When the present invention is employed, a vibration sensor does not need to be newly added. Using a plurality of microphone units set for the purpose of picking up the target sound wave, only the vibration component can be extracted without the influence of the picked-up signal of the sound wave. Thus, since the vibration noise entering into the microphone device having the plurality of microphone units can be cancelled with a high degree of precision using the plurality of microphone units, a microphone device which includes a plurality of microphone units and has superior resistance to vibration can be realized.

It should be noted that the present invention can be realized not only as a device, but also as: an integrated circuit which includes the processing units included in such a device; a method which includes the processing units included in the device as steps; and a program which causes a computer to execute these steps.

BRIEF DESCRIPTION OF DRAWINGS

FIG. 2 is a table showing a signal waveform example, a directivity, and a sensitivity to sound waves of an output signal, according to the first embodiment of the present invention.

| | Numerical References |
|---|---|
| 4, 32, 42, 82, 99 | signal subtraction unit |
| 11 | first microphone unit |
| 12 | second microphone unit |
| 20 | first directivity synthesis unit |
| 22, 81 | signal addition unit |
| 23, 98 | signal amplification unit |
| 30 | second directivity synthesis unit |
| 31, 41, 97 | signal delay unit |
| 33, 43 | frequency characteristic modification unit |
| 40 | third directivity synthesis unit |
| 51 | first time-frequency transformation unit |
| 52 | second time-frequency transformation unit |
| 53 | third time-frequency transformation unit |
| 61 | first signal band limitation unit |
| 62 | second signal band limitation unit |
| 63 | third signal band limitation unit |
| 71 | first signal absolute value calculation unit |
| 72 | second signal absolute value calculation unit |
| 73 | third signal absolute value calculation unit |
| 80 | signal cancellation calculation unit |
| 90, 900 | signal reconstruction unit |
| 91 | signal sign extraction unit |

-continued

| | Numerical References |
|---|---|
| 92 | signal multiplication unit |
| 93 | signal phase extraction unit |
| 94 | signal amplitude-phase synthesis unit |
| 95 | frequency-time transformation unit |
| 100, 200, 300, 400 | noise extraction device |
| 500, 600, 800 | microphone device |

BEST MODE FOR CARRYING OUT THE INVENTION

The following is a description of embodiments of the present invention, with reference to the drawings.

First Embodiment

Figure 1:
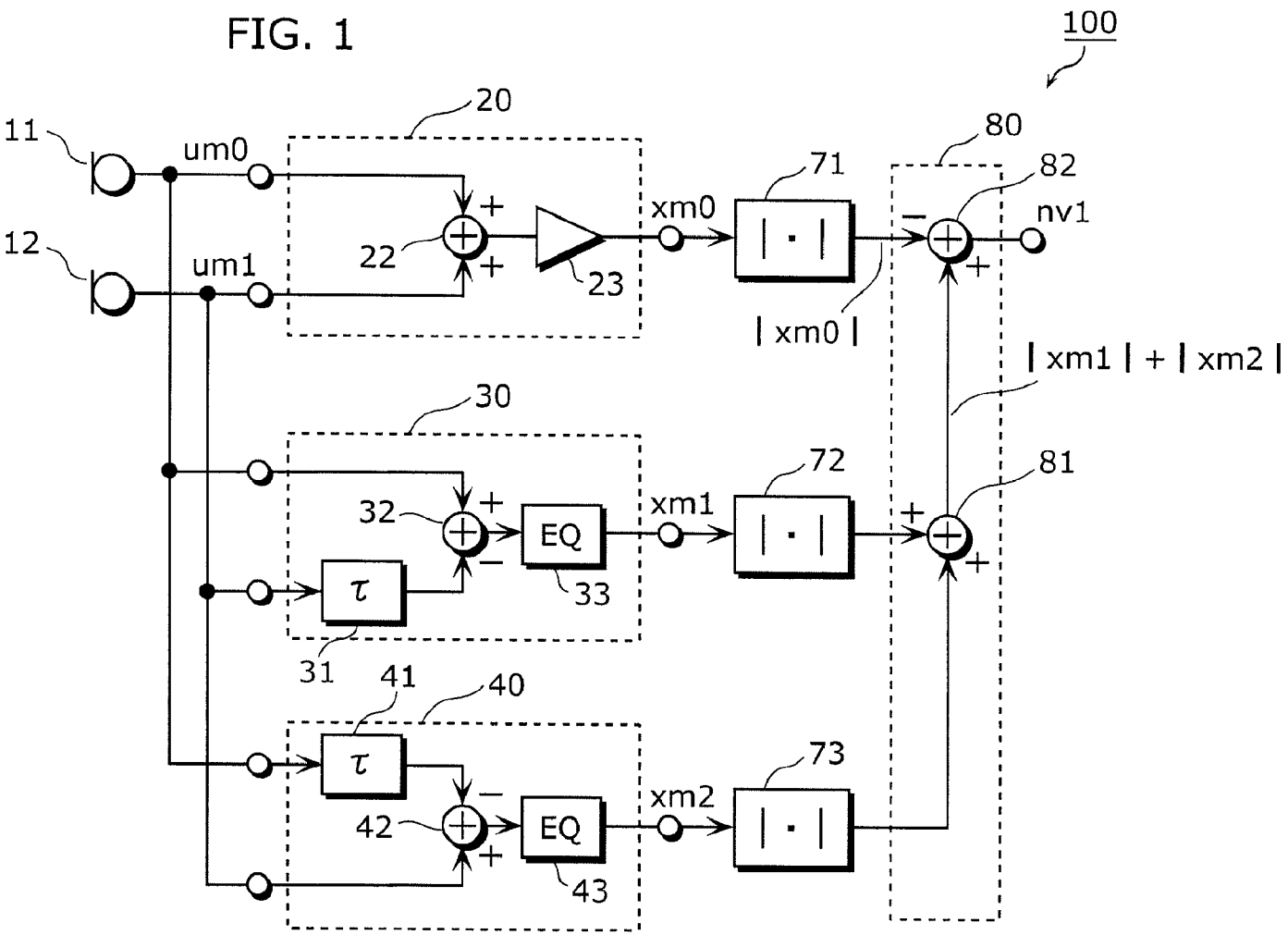
FIG. 1 is a block diagram showing a configuration of a noise extraction device using microphones, according to a first embodiment of the present invention.

FIG. 1 is a block diagram showing a configuration of a noise extraction device using microphones, according to the first embodiment of the present invention. It should be noted here that, in the following description, an initial letter of a name of a time-domain signal is denoted by a lowercase letter and an initial letter of a name of a frequency-domain signal is denoted by an uppercase letter. Also note that xm0 ($n$) is indicated as xm0, and Xm0 (ω) is indicated as Xm0 in the following description.

A noise extraction unit 100 shown in FIG. 1 includes a first microphone unit 11 and a second microphone unit 12, and further includes a first directivity synthesis unit 20, a second directivity synthesis unit 30, a third directivity synthesis unit 40, a first signal absolute value calculation unit 71, a second signal absolute value calculation unit 72, a third signal absolute value calculation unit 73, and a signal cancellation calculation unit 80.

Also, the first directivity synthesis unit 20 includes a signal addition unit 22 and a signal amplification unit 23. The second directivity synthesis unit 30 includes a signal delay unit 31, a signal subtraction unit 32, and a frequency characteristic modification unit 33. The third directivity synthesis unit 40 includes a signal delay unit 41, a signal subtraction unit 42, and a frequency characteristic modification unit 43.

The first directivity synthesis unit 20 receives an output signal um0 from the first microphone unit 11 and an output signal um1 from the second microphone unit 12. The first directivity synthesis unit 20 performs addition-type directivity synthesis on the received signals um0 and um1, and then provides an output of a signal xm0.

The second directivity synthesis unit 30 receives the output signal um0 from the first microphone unit 11 and the output signal um1 from the second microphone unit 12. The second directivity synthesis unit 30 performs directivity synthesis of a sound-pressure gradient type on the received signals um0 and um1, and then provides an output of a signal xm1.

The first directivity synthesis unit 40 receives the output signal um0 from the first microphone unit 11 and the output signal um1 from the second microphone unit 12. The third directivity synthesis unit 40 performs directivity synthesis of sound-pressure gradient type on the received signals um0 and um1, and then provides an output of a signal xm2.

The first signal absolute value calculation unit 71 calculates an absolute value of the output signal xm0 received from the first directivity synthesis unit 20, and then provides an output of the calculated absolute value (referred to as the first output signal hereafter).

Similarly, the second signal absolute value calculation unit 72 calculates an absolute value of the output signal xm1 received from the second directivity synthesis unit 30, and then provides an output of the calculated absolute value (referred to as the second output signal hereafter).

Similarly, the third signal absolute value calculation unit 73 calculates an absolute value of the output signal xm2 received from the third directivity synthesis unit 40, and then provides an output of the calculated absolute value (referred to as the third output signal hereafter).

The signal cancellation calculation unit 80 receives the first output signal from the first signal absolute value calculation unit 71, the second output signal from the second signal absolute value calculation unit 72, and the third output signal from the third signal absolute value calculation unit 73. The signal cancellation calculation unit 80 performs calculation to cancel acoustic signal components of the sound wave from the first output signal, the second output signal, and the third output signal, and then provides an output signal nv1, for example, which is a noise signal component of vibration noise.

It should be noted that, in physical terms, each of the components described above may be implemented as a function executed on a processor which receives the outputs from the first microphone unit 11 and the second microphone unit 12.

The noise extraction device 100 is configured as described so far.

Next, an explanation is given as to an operation of the noise extraction device 100. The following describes vibration noise.

First, an outline of the operation is explained. The noise extraction device 100 extracts a vibration noise component entering into a microphone, using this microphone which is originally intended for picking up a sound. To be more specific, the noise extraction device 100 performs subtraction on the directionally-synthesized output signals which have: different vibration sensitivities; the same directional pattern with respect to sound pressure; and the same effective acoustic center position. By doing so, the noise extraction device 100 cancels a signal of the sound wave coming from every direction (i.e., cancels the sound wave) and extracts only the vibration noise component.

Here, as an output signal from a microphone which has a low vibration sensitivity (i.e., has a high sound-pressure sensitivity), that is, which has a high vibration resistance, the output signal from the first directivity synthesis unit 20 (the first output signal) is used. Also, as an output signal from a microphone which has a high vibration sensitivity (i.e., has a low sound-pressure sensitivity), that is, which has a low vibration resistance, an output signal (synthesized output signal) obtained by performing calculation synthesis on the plurality of output signals respectively from the second directivity synthesis unit 30 and the third directivity synthesis unit 40 (the second output signal and the third output signal) is used.

The following describes the details of the processing performed by the noise extraction device 100 to cancel the sound wave and thus extract the vibration noise.

First, the signal addition unit 22 of the first directivity synthesis unit 20 provides the signal simplification unit 23 with an output of the directionally-synthesized signal obtained by adding the output signal um0 from the first microphone unit 11 and the output signal um1 from the microphone unit 12 together. Next, the signal amplification unit 23 adjusts a gain of the received directionally-synthesized signal and then provides the directionally-synthesized output signal xm0.

It should be noted that the following explanation is given on the assumption that the gain of the signal amplification unit 23 is 1.

Thus, the output signal from the first directivity synthesis unit 20 can be represented by (Equation 1). Here, the signals Xm0 (ω), Um0 (ω), and Um1 (ω) expressed in the frequency domains respectively represent the signals xm0 (*n*), um0 (*n*), and um1 (*n*) expressed in the time domains.

$$Xm0(\omega)=Um0(\omega)+Um1(\omega) \quad \text{(Equation 1)}$$

Next, the signal delay unit 31 of the second directivity synthesis unit 30 delays the output signal um1 from the second microphone unit 12 by a time τ. Then, the signal subtraction unit 32 of the second directivity synthesis unit 30 forms a directivity by subtracting the output signal um1 from the output signal um0 received from the first microphone unit 11. Here, as the directional pattern formed by the second directivity synthesis 30, the directional axis faces in the direction of the first microphone unit 11 on a line connecting the two microphone units (the first microphone unit 11 and the second microphone unit 12).

By setting the delay time τ to (Equation 2), the second directivity synthesis unit 30 can form the directivity that has a cardioid unidirectional pattern.

$$\tau=d/c \text{(where } d \text{ is a spacing between the microphone units and } c \text{ is the velocity of sound)} \quad \text{(Equation 2)}$$

Moreover, the frequency characteristic modification unit 33 of the second directivity synthesis unit 30 modifies the frequency characteristic of the output signal received from the signal subtraction unit 32, and provides the output signal xm1. Here, as a modification characteristic, a characteristic represented by (Equation 3) is used for example. With this, the frequency characteristic, that is, the sound-pressure sensitivity attenuating at 6 dB/oct towards the low frequency range, of the output signal received from the signal subtraction unit 32 can be modified to a flat characteristic.

$$H_{EQ}(\omega)=1/(1-Ae^{-j\omega\tau}) \quad \text{(Equation 3)}$$

Note that A is a constant which is set in order to prevent oscillation when the modification unit is actually realized using a digital filter or the like. In this case here, a value of A is close to 1 and smaller than 1. The following explanation is given on the assumption that A=1, considering that A≈1 in theory. It should be noted that a set value is practically determined depending on the low-frequency limit of a necessary frequency band.

From the description up to this point, the output signal xm1 from the second directivity synthesis unit 30 is represented by (Equation 4).

$$Xm1(\omega)=(Um0(\omega)-Um1(\omega)e^{-j\omega\tau})/(1-Ae^{-j\omega\tau}) \quad \text{(Equation 4)}$$

Note that (Equation 4) is an equation representing common unidirectional synthesis.

Next, the signal delay unit 41 of the third directivity synthesis unit 40 delays the output signal um0 from the first microphone unit 11 by a time τ. Then, the signal subtraction unit 42 of the third directivity synthesis unit 40 forms a directivity by subtracting the output signal um0 from the output signal um1 received from the second microphone unit 12.

Here, as the directional pattern formed by the third directivity synthesis 40, the directional axis faces in the direction of the second microphone unit 12 on the line connecting the two microphone units (the first microphone unit 11 and the second microphone unit 12). As is the case with the second directivity synthesis unit 30, by setting the delay time τ to (Equation 2), the third directivity synthesis unit 40 can form the directivity that has a cardioid unidirectional pattern.

Moreover, the frequency characteristic modification unit 43 of the third directivity synthesis unit 40 modifies the frequency characteristic of the output signal received from the signal subtraction unit 42, and provides the output signal xm2. Here, as a modification characteristic, a characteristic represented by (Equation 3) is used, as is the case with the second directivity synthesis unit 30. From the description up to this point, the output signal xm2 from the third directivity synthesis unit 40 is represented by (Equation 5).

$$Xm2(\omega)=(Um1(\omega)-Um0(\omega)e^{-j\omega\tau})/(1-Ae^{-j\omega\tau}) \quad \text{(Equation 5)}$$

FIG. 2 is a table showing a signal waveform example, a directivity, and a sensitivity to sound waves of an output signal, according to the first embodiment of the present invention.

In FIG. 2, a relationship among the output signal xm0 from the first directivity synthesis unit 20, the output signal xm1 from the second directivity synthesis unit 30, and the output signal xm2 from the third directivity synthesis unit 40 is shown.

In the present example, a mike unit spacing (a unit-to-unit distance) d between the first microphone unit 11 and the second microphone unit 12 is 10 mm. In this case, the output signal xm0, on which the addition-type directivity synthesis has been performed, from the first directivity synthesis unit 20 becomes nearly omni-directional in a frequency band of a long wavelength (1 kHz, for example), with respect to the unit-to-unit distance d. Moreover, the absolute value of the sound pressure sensitivity of the output signal xm0 is high because the signal xm0 is obtained through addition. For this reason, the vibration sensitivity with respect to the sound pressure sensitivity is relatively low. An item under the heading of "Signal waveform" in (i) of the table in FIG. 2 shows an example of a signal waveform of the output signal xm0 from the first directivity synthesis unit 20. In this diagram, each part indicating a sound wave and each part where vibration noise occurs are shown using arrows.

On the other hand, the directivity of the signal xm1, on which the directivity synthesis of sound-pressure gradient type has been performed, from the second directivity synthesis unit 30 is unidirectional. Moreover, the absolute value of the sound pressure sensitivity of the output signal xm1 is low as compared to the case of addition type, because the signal xm1 is obtained through the sound-pressure gradient type (subtraction-type) synthesis. For this reason, the vibration sensitivity with respect to the sound pressure sensitivity is relatively high. The item under the heading of "Signal waveform" in (ii) of the table in FIG. 2 shows an example of a signal waveform of the output signal xm1 from the second directivity synthesis unit 30.

Since the output signal xm1 is high in vibration sensitivity, a signal level in a part where the vibration noise is present is high as compared to the case of the output signal xm0 shown in (i).

The directivity of the signal xm2 received from the third directivity synthesis unit 40 is unidirectional in the direction opposite to xm1. Moreover, the absolute value of the sound pressure sensitivity of the output signal xm2 is similarly low because the signal xm2 is obtained through the sound-pressure gradient type synthesis. For this reason, the vibration sensitivity with respect to the sound pressure sensitivity is relatively high. The item under the heading of "Signal waveform" in (iii) of the table in FIG. 2 shows an example of a signal waveform of the output signal xm2 from the third directivity synthesis unit 40.

As is the case with the output signal xm1 received from the second directivity synthesis unit 30, since the output signal xm2 is high in vibration sensitivity, a signal level of the output signal xm2 received from the third directivity synthesis unit 40 in a part where the vibration noise is present is also high as compared to the case of the output signal xm0 shown in (i).

On the basis of the above explanation, the output signal nv1 from the signal cancellation calculation unit 80 is expressed by (Equation 6).

Here, note how the output of the output signal nv1 is provided. The output signal xm0, the output signal xm1, and the output signal xm2 are received, and then the outputs of the first output signal, the second output signal, and the third output signal are provided respectively by the first signal absolute value calculation unit 71, the second signal absolute value calculation unit 72, and the third signal absolute value calculation unit 73. Then, the calculation is performed on the provided first output signal, the provided second output signal, and the provided third signal by the signal addition unit 81 and the signal subtraction unit 82 of the signal cancellation unit 80. As a result, the output signal nv1 is provided.

$$nv1=|xm1|+|xm2|-|xm0| \quad \text{(Equation 6)}$$

It should be noted that the signal cancellation calculation unit 80 shown in FIG. 1 first obtains the synthesized output signal (|xm1|+|xm2|), and then subtracts the first output signal (|xm0|) However, as long as an output equivalent to (Equation 6) can be obtained, the order in which the operations are performed does not matter, as represented by (Equation 6).

When this operation is represented based on the frequency domains, substitutions of the above-described (Equation 1), (Equation 4), and (Equation 5) yield (Equation 7).

$$Nv1(\omega)=\left|\frac{(Um0(\omega)-Um1(\omega)e^{-j\omega\tau})}{(1-Ae^{-j\omega\tau})}\right|+\left|\frac{(Um1(\omega)-Um0(\omega)e^{-j\omega\tau})}{(1-Ae^{-j\omega\tau})}\right|-|Um0(\omega)+Um1(\omega)| \quad \text{(Equation 7)}$$

Next, using (Equation 7), an explanation is given as to the sensitivity to sound waves and the sensitivity to vibration of this output signal nv1.

First, the sensitivity to sound waves can be represented by the output signal Nv1 (ω) relative to the sound waves. As described above, according to the directivity synthesis methods used by the first directivity synthesis unit 20, the second directivity synthesis unit 30, and the directivity synthesis 40, the polarities of directional main lobes are the same and there are no side-lobes. Moreover, since the effective acoustic center position is located midway between the two microphone units, meaning that the two microphone units have the same effective acoustic center position, the signs of the absolute values in (Equation 7) (phase rotation) are the same. Accordingly, the output signal Nv1 (ω) relative to the sound waves is equivalent to (Equation 8) where the absolute value expressions are removed.

$$Nv1(\omega)=\frac{(Um0(\omega)-Um1(\omega)e^{-j\omega\tau})}{(1-Ae^{-j\omega\tau})}+\frac{(Um1(\omega)-Um0(\omega)e^{-j\omega\tau})}{(1-Ae^{-j\omega\tau})}- \quad \text{(Equation 8)}$$

-continued $$
\begin{aligned}
&(Um0(\omega) + Um1(\omega)) \\
&= \frac{(Um0(\omega) - Um1(\omega)e^{-j\omega\tau}) + (Um1(\omega) - Um0(\omega)e^{-j\omega\tau})}{(1 - Ae^{-j\omega\tau})} - (Um0(\omega) + Um1(\omega)) \\
&= \frac{(1 - e^{-j\omega\tau})(Um0(\omega) + Um1(\omega))}{(1 - Ae^{-j\omega\tau})} - (Um0(\omega) + Um1(\omega)) \\
&\cong 0
\end{aligned}
$$

According to (Equation 8), the sensitivities to the sound waves are canceled out by the output signals from the first directivity synthesis unit 20, the second directivity synthesis unit 30, and the third directivity synthesis unit 40. Thus, it is understood that the output signal nv1 of the first embodiment is 0.

Note, however, that according to (Equation 8), spatial aliasing occurs at high frequencies where the wavelength is ½ or shorter with respect to the mike unit spacing d (in this case, 17 kHz or higher (c/(2*d)=17 kHz)). In the frequency band where this spatial aliasing occurs, side-lobes are caused with the polarity reversed, and this is not practically viable. Here, the spatial aliasing is a phenomenon in which a path difference of sounds becomes an integral multiple of the wavelength in the directions other than the frontal direction and the sounds are mutually reinforced, thereby causing unnecessary directivities. On account of this, the mike unit spacing d or the like needs to be set to an appropriate distance depending on a necessary band, and the frequency bands to be used need to be limited.

Next, vibration noise is explained. The vibration noise entering into the first microphone unit 11 and the second microphone unit 12 includes noise with a correlation and noise with no correlation between the output signals of these two microphone units. However, the noise with a correlation is not a problem since the vibration component is attenuated together with the sound wave when the directivity synthesis of sound-pressure gradient type is performed. It is the noise with no correlation that becomes a problem in particular.

Thus, one of Um0 (ω) and Um1 (ω) that was deleted according to (Equation 7) can be considered as the output of the vibration noise caused by the other microphone unit.

Hence, when cleaning up by deleting Um1 (ω), the output signal of the vibration noise relating to the output signal um0 from the first microphone unit 11 is represented by (Equation 9).

$$
Nv1(\omega) = |Um0(\omega)|\left\{\frac{2}{|(1 - Ae^{-j\omega\tau})|} - 1\right\} \qquad \text{(Equation 9)}
$$

(Equation 9) represents a level of the output signal Nv1 (ω), letting the intensity of the output signal of the vibration noise provided from the first directivity synthesis unit 20 be |Um0 (ω)| when the vibration noise occurs to the first microphone unit 11.

Figure 3:
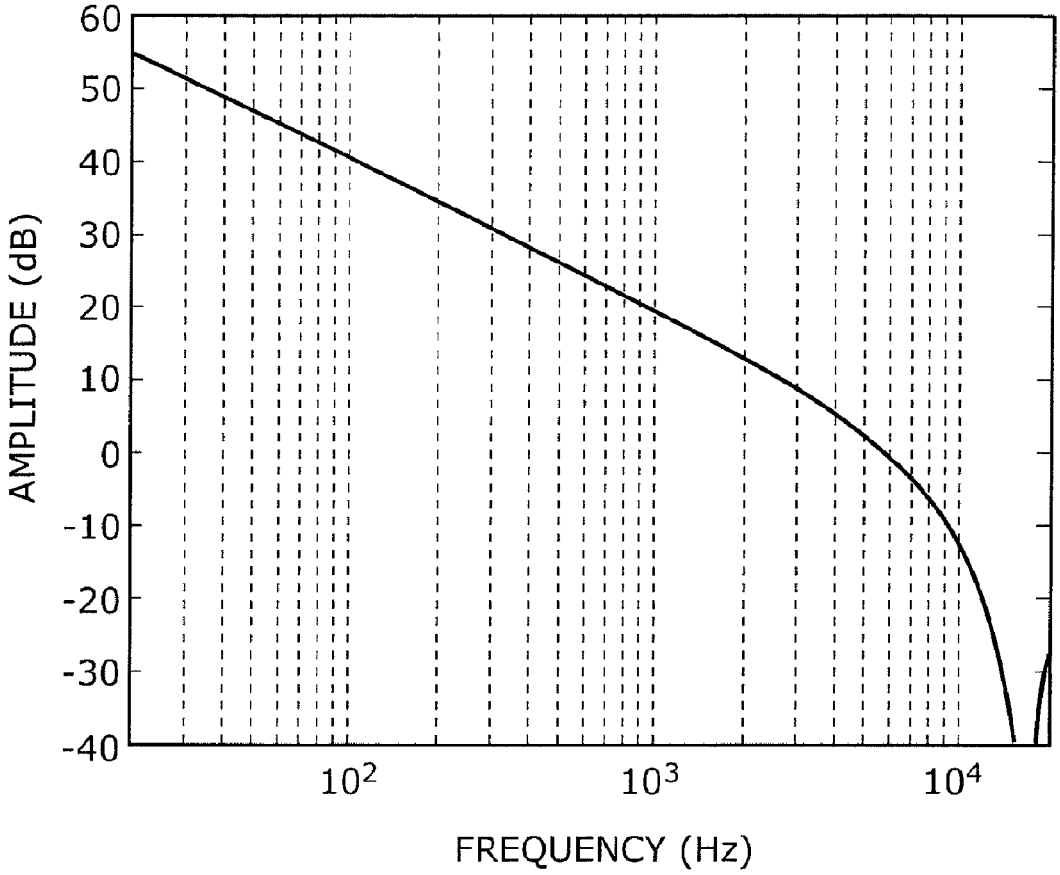
FIG. 3 is a diagram showing a vibration-extraction sensitivity based on a level of vibration noise of an individual microphone unit, according to the first embodiment of the present invention.

FIG. 3 is a diagram showing a vibration-extraction sensitivity based on the level of vibration noise of an individual microphone unit, according to the first embodiment of the present invention.

In FIG. 3, part in {·} of (Equation 9) is shown in graph form, from which it can be seen that the lower the frequency, the higher the detection level.

The detection level is higher at the lower frequencies as shown in FIG. 3 because the modification characteristic represented by (Equation 3) is added by the frequency characteristic modification units 33 and 43 to the output signal xm1 and the output signal xm2 which are high in vibration sensitivity and thus likely to pick up vibrations. This results in that the characteristic of the output signal Nv1 is close to the frequency characteristic of the vibration noise included in the output signal xm1 or the output signal xm2.

In this way, the sensitivities to the sound wave balance each other out (the sound wave is canceled) in the noise extraction device 100 as represented by (Equation 8). As shown by (Equation 9), the vibration noise entering into the noise extraction device 100 is obtained as the output signal Nv1 which represents the amplitude value of the vibration noise, with the vibration noise being a component occurring separately to the first microphone unit 11 and the second microphone unit 12.

The item under the heading of "Signal waveform" in (iv) of the table in FIG. 2 shows an example of a signal waveform of the output signal nv1 from the signal cancellation calculation unit 80. As shown in FIG. 2, the output signal nv1 from the signal cancellation calculation unit 80 does not have the sensitivity to the sound wave (cancels the sound wave), so that the vibration noise (information regarding the waveform amplitude of the vibration noise) can be extracted.

As described so far, using the noise extraction device 100 according to the first embodiment of the present invention, only the vibration component can be extracted using the plurality of microphone units (the first microphone unit 11 and the second microphone unit 12) without the influence of the picked-up signal of the sound wave. Thus, control to cancel the vibration noise entering into the microphone device having the plurality of microphone units (the first microphone unit 11 and the second microphone unit 12) can be performed with a high degree of precision using these microphone units. Accordingly, a microphone device which includes a plurality of microphone units and has superior resistance to vibration can be realized.

Moreover, the noise extraction device 100 can extract the vibration component using the output values from the plurality of directivity synthesis units (the first directivity synthesis unit 20, the second directivity synthesis unit 30, and the third directivity synthesis unit 40). More specifically, the noise extraction device 100 extracts the vibration component, on the basis that the synthesized output signal from the signal cancellation calculation unit 80 (the output from the signal addition unit) includes relatively more vibration components of the acoustic signal as compared to the first output signal which is the output signal from the first directivity synthesis unit 20. Hence, the microphone device which is originally intended for picking up a sound wave can be used as a vibration sensor in addition to the function as a microphone.

Furthermore, the output signal from the signal addition unit 81 has an attribute to extract the vibration component. Thus, the vibration component can be extracted through the subtraction performed on the first output signal and the output signal from the signal addition unit 81. Hence, without newly adding a dedicated sensor, the microphone device which is originally intended for picking up a sound wave can be used as a vibration sensor in addition to the function as a microphone.

It should be noted that as long as the signal cancellation calculation unit 80 can obtain an output equivalent to the addition result as represented by (Equation 6), the order in which the operations are performed does not matter.

For the sake of simplicity, the explanation has been given in the first embodiment of the present invention, by stating that the output from the first directivity synthesis unit 20 shows omni-directivity and that each output from the second directivity synthesis unit 30 and the third directivity synthesis unit 40 shows unidirectivity. However, when the directional patterns agree with each other, it does not have to be the mentioned pair of omni-directivity and unidirectivity. For example, the directional pattern of the absolute value obtained by adding the output signals from the first directivity synthesis unit 20, the second directivity synthesis unit 30, and the third directivity synthesis unit 40 together does not show the omni-directional pattern but does show the bi-directional pattern in the frequency band around 17 kHz in the first embodiment. However, it does not matter as long as the directional patterns agree with each other.

Moreover, vibration noise has been focused as noise entering into the microphone device in the above description. Note that the present invention provides a method for cancelling a signal of a picked-up sound wave and extracting only noise. Therefore, the same effect can be achieved in the case of, for example, wind noise which is different in signal behavior from the sound wave and similar in property to the vibration noise. This is to say, since wind noise, which becomes a problem for the microphone device, occurs indiscriminately to the plurality of microphone units, the same operation performed as in the case of vibration noise can be applied. Here, the wind noise refers to noise caused when the microphone is buffeted by wind. Hence, without newly adding a dedicated sensor, the microphone device which is originally intended for picking up a sound wave can be used as a wind noise sensor in addition to the function as a microphone.

Furthermore, the explanation has been given in the first embodiment of the present invention, as to the case where the number of the microphone units is two. However, the present invention is not limited to this. Three or more microphone units may be used, and the directionally-synthesized outputs which are different in sound-pressure sensitivity may be provided so that the signals cancel each other based on the directional patterns (cancel the sound wave) in order only for a noise component to be extracted.

Second Embodiment

The following is a description of the second embodiment of the present invention.

Figure 4:
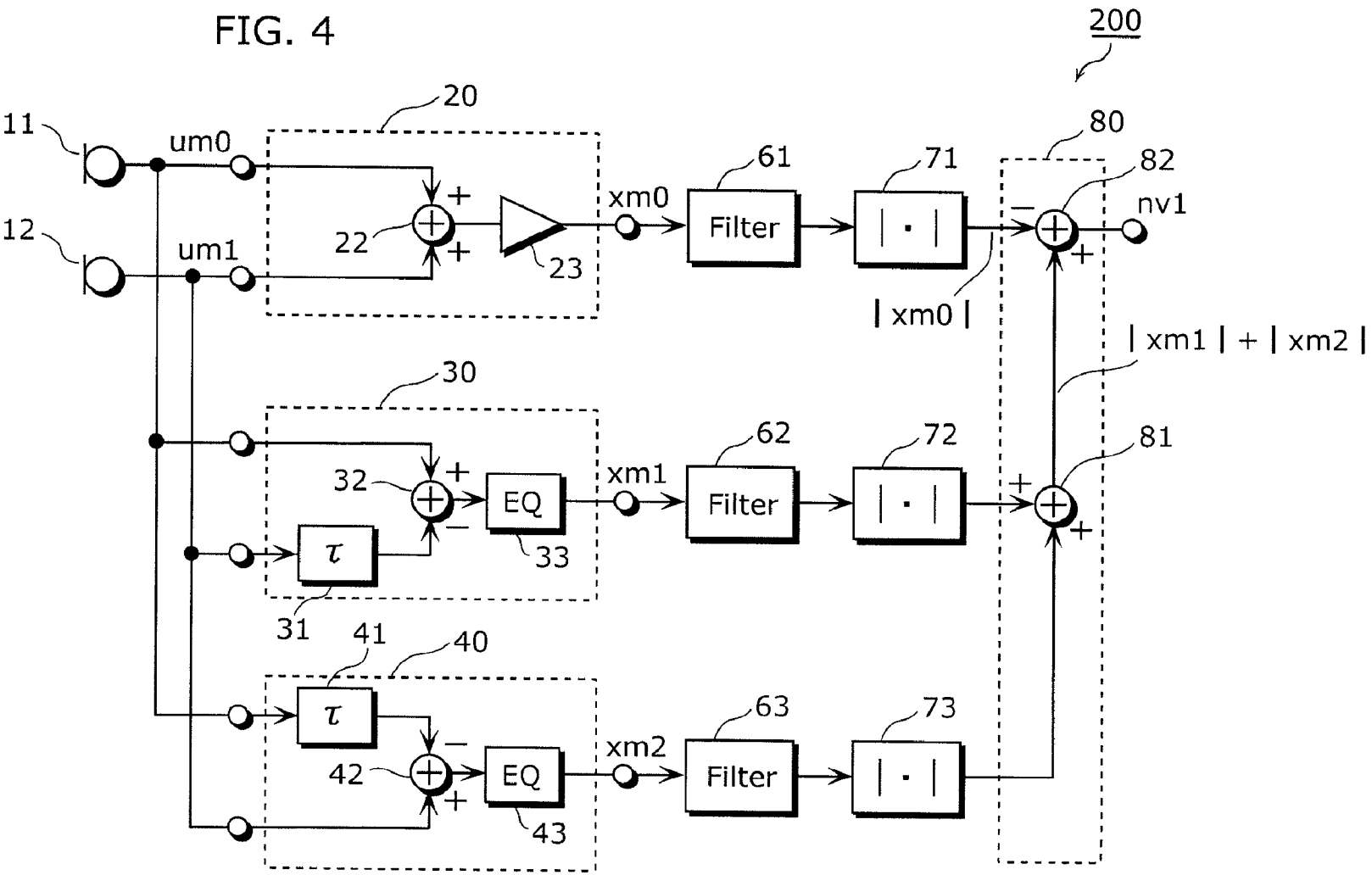
FIG. 4 is a block diagram showing a configuration of a noise extraction device using microphones, according to a second embodiment of the present invention.

FIG. 4 is a block diagram showing a configuration of a noise extraction device using microphones, according to the second embodiment of the present invention. The components common to those in FIG. 1 are assigned the same numerals used in FIG. 1, and thus the detailed explanations are omitted here.

A noise extraction device 200 shown in FIG. 4 includes a first microphone unit 11 and a second microphone unit 12, and further includes a first directivity synthesis unit 20, a second directivity synthesis unit 30, a third directivity synthesis unit 40, a first signal band limitation unit 61, a second signal band limitation unit 62, a third signal band limitation unit 63, a first signal absolute value calculation unit 71, a second signal absolute value calculation unit 72, a third signal absolute value calculation unit 73, and a signal cancellation calculation unit 80.

Also, the first directivity synthesis unit 20 includes a signal addition unit 22 and a signal amplification unit 23. The second directivity synthesis unit 30 includes a signal delay unit 31, a signal subtraction unit 32, and a frequency characteristic modification unit 33. The third directivity synthesis unit 40 includes a signal delay unit 41, a signal subtraction unit 42, and a frequency characteristic modification unit 43.

The noise extraction device 200 shown in FIG. 4 is different from the noise extraction device 100 of the first embodiment in that the first signal band limitation unit 61, the second signal band limitation unit 62, and the third signal band limitation unit 63 are set respectively between the first, second, and third directivity synthesis units 20, 30, and 40 and the first, second, and third signal absolute value calculation units 71, 72, and 73.

In FIG. 4, the first signal band limitation unit 61 limits a signal band for the output signal xm0 received from the first directivity synthesis unit 20 before providing the output of this signal.

Similarly, the second signal band limitation unit 62 limits a signal band for the output signal xm1 received from the second directivity synthesis unit 30 before providing the output of this signal.

Similarly, the third signal band limitation unit 63 limits a signal band for the output signal xm2 received from the third directivity synthesis unit 40 before providing the output of this signal.

The other components are the same as those in the first embodiment. The first directivity synthesis unit 20 performs the addition-type directivity synthesis on an output signal um0 from the first microphone unit 11 and an output signal um1 from the second microphone unit 12, and then provides an output signal xm0. The second directivity synthesis unit 30 performs directivity synthesis of sound-pressure gradient type on the output signal um0 from the first microphone unit 11 and the output signal um1 from the second microphone unit 12, and then provides an output signal xm1. The third directivity synthesis unit 40 performs directivity synthesis of sound-pressure gradient type on the output signal um0 from the first microphone unit 11 and the output signal um1 from the second microphone unit 12, and then provides an output signal xm2.

The first signal absolute value calculation unit 71 calculates an absolute value of the output signal received from the first signal band limitation unit 61, and then provides an output of the calculated absolute value. The second signal absolute value calculation unit 72 calculates an absolute value of the output signal received from the second signal band limitation unit 62, and then provides an output of the calculated absolute value. The third signal absolute value calculation unit 73 calculates an absolute value of the output signal received from the third signal band limitation unit 63, and then provides an output of the calculated absolute value.

The signal cancellation calculation unit 80 receives a first output signal from the first signal absolute value calculation unit 71, a second output signal from the second signal absolute value calculation unit 72, and a third output signal from the third signal absolute value calculation unit 73. The signal cancellation calculation unit 80 performs addition-subtraction processing on the first output signal, the second output signal, and the third output signal to cancel acoustic signal components of a sound wave, and then provides an output signal nv1 which is a noise signal component of vibration noise.

The noise extraction device 200 is configured as described so far.

Next, an operation of the noise extraction device 200 is explained. An explanation is given about the first signal band limitation unit 61, the second signal band limitation unit 62, and the third signal limitation unit 63 of FIG. 4, which are not present in the first embodiment. The other components are the same as those in the first embodiment, and thus the detailed explanations are omitted here.

When the frequency band from which vibration noise is to be extracted is limited, each of the first signal band limitation unit 61, the second signal band limitation unit 62, and the third signal limitation unit 63 can extract the vibration noise from the frequency band, from which the vibration noise is to be extracted, by limiting the frequency band of a to-be-provided output signal. On this account, the noise extraction device 200 can extract the vibration noise after removing components which can be obstructive to the detection in the frequency band where vibration noise does not occur. Thus, the sensitivity of vibration noise detection of the noise extraction device 200, namely, the detection accuracy of the noise extraction device 200 can be increased.

The first directivity synthesis unit 20, the second directivity synthesis unit 30, and the third directivity synthesis unit 40 may include parts where the directional pattern deviates from an ideal state due to, for example, the influence of reflection and diffraction caused because these units are mounted in a housing of the noise extraction device 200. In this case, after the first signal band limitation unit 61, the second signal band limitation unit 62, and the third signal band limitation unit 63 remove the frequency bands where problems may take place, the subsequent processing can be performed. Accordingly, the noise extraction device 200 can reduce extraction errors caused when vibration noise is extracted.

Moreover, there is a case where the directional patterns of the first directivity synthesis unit 20, the second directivity synthesis unit 30, and the third directivity synthesis unit 40 can be formed so as to cancel the acoustic signal of the sound wave only in a specific frequency band. In this case, the first signal band limitation unit 61, the second signal band limitation unit 62, and the third signal band limitation unit 63 allow the processing to be performed only for the specific frequency band. Accordingly, the noise extraction device 200 can increase the vibration detection sensitivity required when vibration noise is extracted.

As described so far, when there is a frequency band which includes a factor causing the configuration of the noise extraction device 100 of the first embodiment to operate incorrectly, the noise extraction device 200 of the second embodiment can remove such a frequency band and thus can make a determination of the presence or absence of vibration noise with precision.

Third Embodiment

The following is a description of the third embodiment of the present invention.

Figure 5:
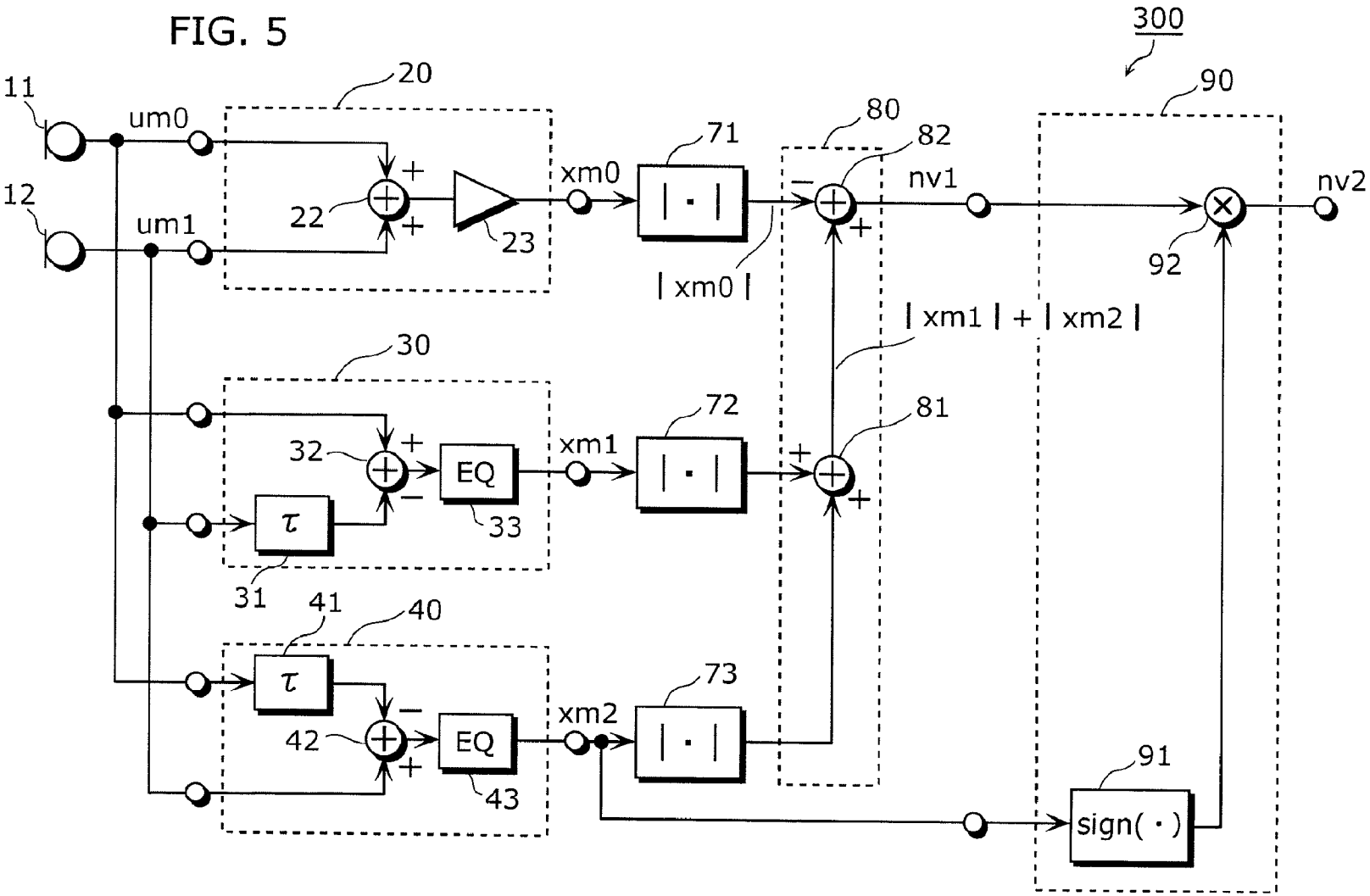
FIG. 5 is a block diagram showing a configuration of a noise extraction device using microphones, according to a third embodiment of the present invention.

FIG. 5 is a block diagram showing a configuration of a noise extraction device using microphones, according to the third embodiment of the present invention. The components common to those in FIG. 1 and FIG. 4 are assigned the same numerals used in FIG. 1 and FIG. 4, and thus the detailed explanations are omitted here.

The noise extraction device 300 shown in FIG. 5 is different from the noise extraction device 100 of the first embodiment in that a signal reconstruction unit 90 is set.

The signal reconstruction unit 90 includes a signal sign extraction unit 91 and a signal multiplication unit 92. The signal reconstruction unit 90 receives: the output signal nv1 showing vibration noise amplitude information from the signal cancellation calculation unit 80; and the output signal xm2 from the third directivity synthesis unit 40, and provides an output signal nv2.

To be more specific, the signal sign extraction unit 91 extracts a signal sign of the output signal xm2 received from the third directivity synthesis unit 40.

The signal multiplication unit 92 multiplies the output signal nv1 by the signal sign of the output signal xm2, the output signal nv1 being received from the signal cancellation calculation unit 80 and showing the vibration noise amplitude information. Then, the signal multiplication unit 92 provides the output signal nv2.

The other components are the same as those in the first embodiment. The first directivity synthesis unit 20 performs the addition-type directivity synthesis on an output signal um0 from the first microphone unit 11 and an output signal um1 from the second microphone unit 12, and then provides an output signal xm0. The second directivity synthesis unit 30 performs directivity synthesis of sound-pressure gradient type on the output signal um0 from the first microphone unit 11 and the output signal um1 from the second microphone unit 12, and then provides an output signal xm1. The third directivity synthesis unit 40 performs directivity synthesis of sound-pressure gradient type on the output signal um0 from the first microphone unit 11 and the output signal um1 from the second microphone unit 12, and then provides an output signal xm2.

The first signal absolute value calculation unit 71 calculates an absolute value of the output signal xm0 received from the first directivity synthesis unit 20, and then provides an output of the calculated absolute value. The second signal absolute value calculation unit 72 calculates an absolute value of the output signal xm1 received from the second directivity synthesis unit 30, and then provides an output of the calculated absolute value. The third signal absolute value calculation unit 73 calculates an absolute value of the output signal xm2 received from the third directivity synthesis unit 40, and then provides an output of the calculated absolute value.

The signal cancellation calculation unit 80 receives a first output signal from the first signal absolute value calculation unit 71, a second output signal from the second signal absolute value calculation unit 72, and a third output signal from the third signal absolute value calculation unit 73. The signal cancellation calculation unit 80 performs addition-subtraction processing on the first output signal, the second output signal, and the third output signal to cancel acoustic signal components of a sound wave, and then provides an output signal nv1, for example, which is a noise signal component of vibration noise.

The noise extraction device 300 is configured as described so far.

Next, an operation of the noise extraction device 300 is explained. An explanation is given about the signal reconstruction unit 90 shown in FIG. 5 that is not present in the first embodiment. The other components are the same as those in the first embodiment, and thus the detailed explanations are omitted here.

The signal reconstruction unit 90 includes the signal sign extraction unit 91 and the signal multiplication unit 92. The output signal nv1 from the signal cancellation calculation unit 80 can be considered to include the vibration noise components extracted from the output signal xm1 and the output signal xm2 respectively from the second directivity synthesis unit 30 and the third directivity synthesis unit 40 which are high in vibration sensitivity. This can also be seen from the values of the signal waveform which are all in a positive direction as shown in (iv) of the table in FIG. 2. Here, this signal waveform is obtained by the signal cancellation calculation unit 80 as a result of the calculation according to (Equation 6).

When a vibration signal added to um0, for example, is followed on the block diagram shown in FIG. 5 as the vibration noise included in the output signal xm1 and the output signal xm2, a vibration signal appears in xm1 without delay and a vibration signal appears in xm2 after a delay of a time $\tau$ in opposite phase.

The absolute values of the output signal xm1 and the output signal xm2 are calculated respectively by the second signal absolute value calculation unit 72 and the third signal absolute value calculation unit 73, and are added together by the signal addition unit 81. For this reason, the vibration noise included in a signal (|xm1|+|xm2|) provided by the signal addition unit 81 shows a value which is approximately twice as large as the vibration noise included in each of the signals.

On the other hand, the output signal xm0 from the first directivity synthesis unit 20 is low in vibration sensitivity. Thus, the output from the signal cancellation calculation unit 80 includes the amplitude information twice as much as the vibration noise in the output signal xm1 or the output signal xm2. By adding a positive or negative sign, the waveform of the vibration noise can be reconstructed.

Here, in the signal cancellation calculation unit 80, the signal |xm0| is subtracted by the signal subtraction unit 82 from the signal (|xm1|+|xm2|) added together by the signal addition unit 81. Since a value of the vibration noise included in the output signal |xm0| is small, the vibration noise included in the output signal nv1 that is obtained as the subtraction result is approximately the same as the vibration noise included in the signal (|xm1|+|xm2|).

Moreover, because the output signal xm2 is a directionally-synthesized output signal which is high in vibration sensitivity, the signal strongly reflects the positive or negative sign of the vibration noise waveform in an interval where the vibration noise occurs.

Thus, the signal reconstruction unit 90 can reconstruct the waveform of the vibration noise in simulation by multiplying nv1 which is the amplitude information of the vibration noise by the sign extracted from xm2.

As described so far, using the noise extraction device 300 according to the third embodiment, the vibration noise waveform can be extracted using the plurality of microphone units (the first microphone unit 11 and the second microphone unit 12) without the influence of the picked-up signal of the sound wave. Thus, the processing to cancel the vibration noise entering into the microphone device having the plurality of microphone units (the first microphone unit 11 and the second microphone unit 12) (the control to counteract the vibration noise) or the processing to suppress the vibration noise components can be performed with a high degree of precision using the plurality of microphone units. Accordingly, a microphone device which includes a plurality of microphone units and has superior resistance to vibration can be realized. Moreover, without newly adding a dedicated sensor, the microphone device which is originally intended for picking up a sound wave can be used as a vibration sensor in addition to the function as a microphone.

Fourth Embodiment

The following is a description of the fourth embodiment of the present invention.

Figure 6:
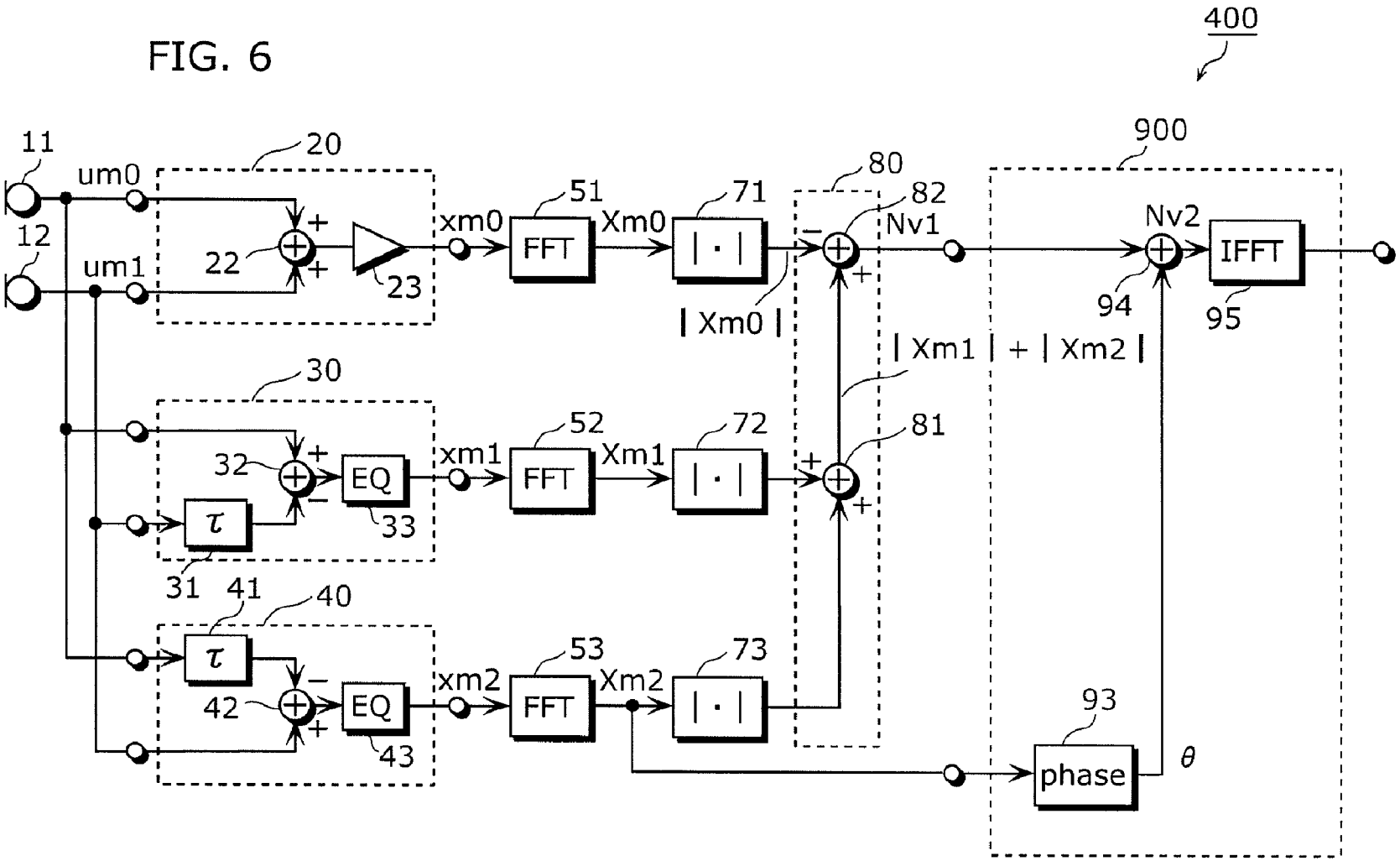
FIG. 6 is a block diagram showing a configuration of a noise extraction device using microphones, according to a fourth embodiment of the present invention.

FIG. 6 is a block diagram showing a configuration of a noise extraction device using microphones, according to the fourth embodiment of the present invention. The components common to those in FIG. 5 are assigned the same numerals used in FIG. 5, and thus the detailed explanations are omitted here.

A noise extraction device 400 shown in FIG. 6 is different from the noise extraction device 300 of the third embodiment as follows. Firstly, a first time-frequency transformation unit 51, a second time-frequency transformation unit 52, and a third time-frequency transformation unit 53 are set respectively subsequent to the first directivity synthesis unit 20, the second directivity synthesis unit 30, and the third directivity synthesis unit 40. Secondly, the signal reconstruction unit 90 is changed to a signal reconstruction unit 900. More specifically, while the signal reconstruction unit 90 of the third embodiment includes the signal sign extraction unit 91 and the signal multiplication unit 92, the signal reconstruction unit 900 shown in FIG. 6 includes a signal phase extraction unit 93, a signal amplitude-phase synthesis unit 94, and a frequency-time transformation unit 95. The output signal obtained as a result of estimating a spectrum for each frequency from the amplitude information and the phase information of the output signal which has been transformed into a frequency-domain signal is transformed into a time-domain signal by the frequency-time transformation unit 95, and then an output of a resultant output signal nv2 is provided from the signal reconstruction unit 900.

The other components are the same as those in the third embodiment. The first directivity synthesis unit 20 performs the addition-type directivity synthesis on an output signal um0 from the first microphone unit 11 and an output signal um1 from the second microphone unit 12, and then provides an output signal xm0. The second directivity synthesis unit 30 performs directivity synthesis of sound-pressure gradient type on the output signal um0 from the first microphone unit 11 and the output signal um1 from the second microphone unit 12, and then provides an output signal xm1. The third directivity synthesis unit 40 performs directivity synthesis of sound-pressure gradient type on the output signal um0 from the first microphone unit 11 and the output signal um1 from the second microphone unit 12, and then provides an output signal xm2.

Moreover, the first time-frequency transformation unit 51 transforms the output signal xm0 received from the first directivity synthesis unit 20, from the time domain to the frequency domain. Similarly, the second time-frequency transformation unit 52 transforms the output signal xm1 received from the second directivity synthesis unit 30, from the time domain to the frequency domain. The third time-frequency transformation unit 53 transforms the output signal xm2 received from the third directivity synthesis unit 40, from the time domain to the frequency domain. It should be noted that the first time-frequency transformation unit 51, the second time-frequency transformation unit 52, and the third time-frequency transformation unit 53 are indicated by FFT (Fast Fourier Transform) in the diagram.

The first signal absolute value calculation unit 71 calculates an absolute value of the output signal xm0 received from the first time-frequency transformation unit 51 for each frequency component, and then provides an output of the calculated absolute value. The second signal absolute value calculation unit 72 calculates an absolute value of the output signal xm1 received from the second time-frequency transformation unit 52 for each frequency component, and then provides an output of the calculated absolute value. The third signal absolute value calculation unit 73 calculates an absolute value of the output signal xm2 received from the third time-frequency transformation unit 53 for each frequency component, and then provides an output of the calculated absolute value.

The signal cancellation calculation unit 80 receives a first output signal |Xm0| from the first signal absolute value calculation unit 71, a second output signal |Xm1| from the second signal absolute value calculation unit 72, and a third output signal |Xm2| from the third signal absolute value calculation unit 73. The signal cancellation calculation unit 80 performs addition-subtraction processing on the first output signal |Xm0|, the second output signal |Xm1|, and the third output signal |Xm2| to cancel acoustic signal components of a sound wave, and then provides an output signal Nv1, for example, which is a noise signal component of vibration noise.

The signal reconstruction unit 900 includes the signal phase extraction unit 93, the signal amplitude-phase synthesis unit 94, and the frequency-time transformation unit 95. The signal reconstruction unit 900 receives: the output signal Nv1 showing the vibration noise amplitude information that is received from by the signal cancellation calculation unit 80; and the output signal Xm2 from the third directivity synthesis unit 40, and then provides the output signal nv2.

To be more specific, the signal phase extraction unit 93 extracts a signal phase of the output signal Xm2 from the third directivity synthesis unit 40.

The signal amplitude-phase synthesis unit 94 performs multiplicative synthesis on the output signal Nv1 showing the amplitude spectrum information of the vibration noise that is received from the signal cancellation calculation unit 80 and the signal phase of the output signal Xm2 showing the spectrum of the directional output signal xm2. Then, the signal amplitude-phase synthesis unit 94 provides the output signal Nv2 showing the spectrum.

The frequency-time transformation unit 95 transforms the output signal Nv2 showing the spectrum that is received from the signal amplitude-phase synthesis unit 94 into a temporal signal which is then provided as the outputs signal nv2. It should be noted that the frequency-time transformation unit 95 is indicated by IFFT (Inverse Fast Fourier Transform) in the diagram.

The noise extraction device 400 is configured as described so far.

Next, an operation of the noise extraction device 400 is explained.

An explanation is given about the first time-frequency transformation unit 51, the second time-frequency transformation unit 52, the third time-frequency transformation unit 53, and the signal reconstruction unit 900 shown in FIG. 6 that are not present in the third embodiment. The output signal spectrum is estimated from the amplitude information and the phase information for each frequency of the frequency domain by the first time-frequency transformation unit 51, the second time-frequency transformation unit 52, the third time-frequency transformation unit 53, and the signal reconstruction unit 900 and, as a result, the noise extraction device 400 obtains the output signal nv2. The other components are the same as those in the first embodiment, and thus the explanations are omitted her.

Note that, in the case of the noise extraction device 300 in the third embodiment described above, the signal sign used for reconstructing the vibration noise waveform is obtained from the signal waveform of xm2 by the signal sign extraction unit 91. To be more specific, xm2 includes acoustic signal components and vibration noise components of the sound wave, meaning that the signal sign information used for reconstructing the vibration noise waveform may have an error due to the influence of the sound wave.

In the case of the noise extraction device 400 of the fourth embodiment, on the other hand, the processing of cancelling the sound wave component to estimate the amplitude component of the vibration noise and the processing performed by the signal phase extraction unit 93 to extract the phase information are executed for each frequency component. With this, in particular, errors due to signal superposition (sound wave and vibration) can be reduced in a part where the phase information is to be extracted, thereby improving the precision in reconstructing the vibration noise waveform.

As described so far, using the noise extraction device 400 according to the fourth embodiment, the vibration noise waveform can be extracted with a high degree of precision using the plurality of microphone units (the first microphone unit 11 and the second microphone unit 12) without the influence of the picked-up signal of the sound wave. Thus, the precision (performance) in executing the processing to cancel the vibration noise entering into the microphone device having the plurality of microphone units (the first microphone unit 11 and the second microphone unit 12) (the control to counteract the vibration noise) or the processing to suppress the vibration noise components using the plurality of microphone units, can be improved. Accordingly, a microphone device which includes a plurality of microphone units and has superior resistance to vibration can be realized. Moreover, when the microphone device is used as a vibration sensor, the effect of improving the precision in detecting the vibration noise with less influence of the sound wave can be obtained.

Fifth Embodiment

The following is a description of the fifth embodiment of the present invention.

Figure 7:
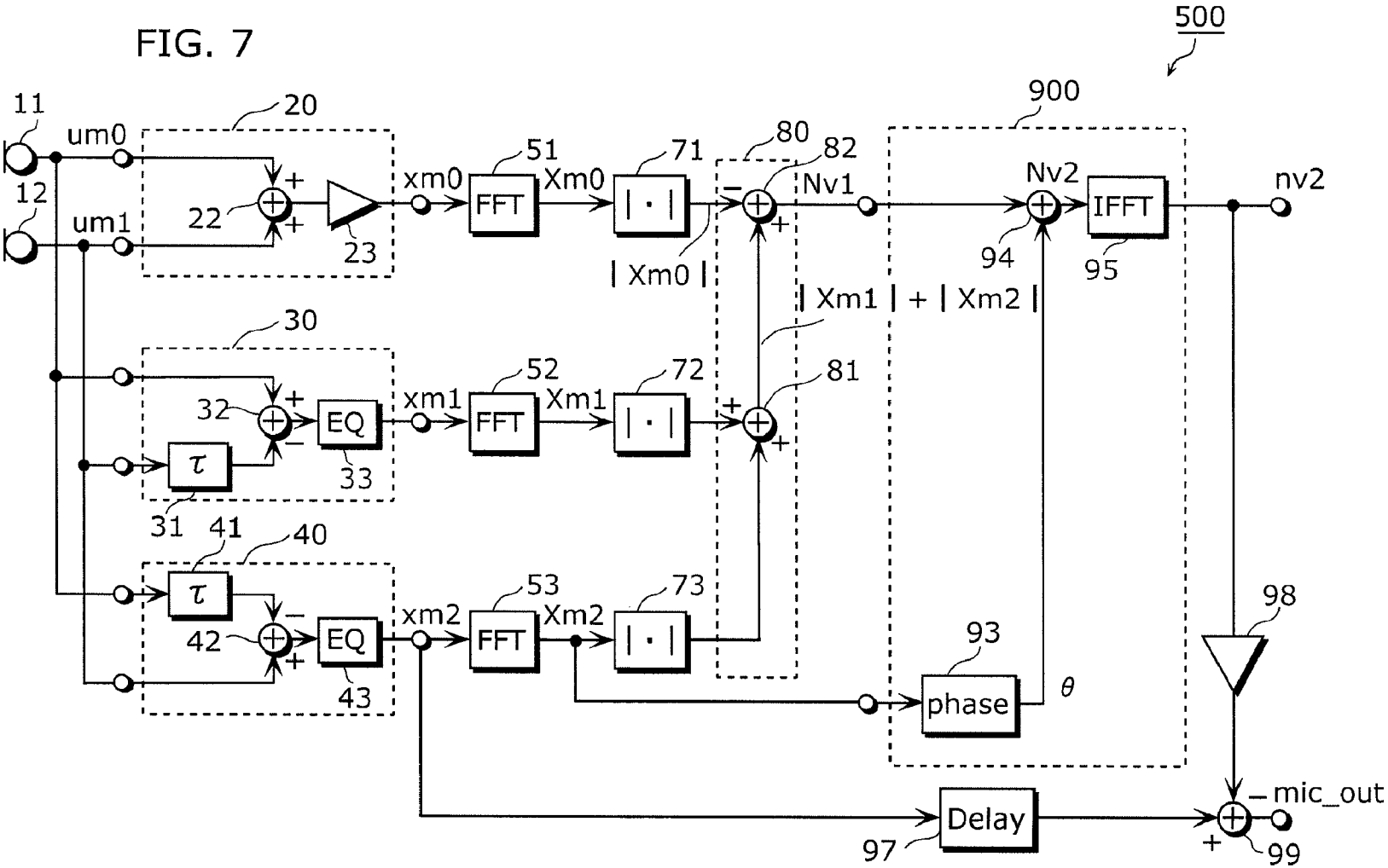
FIG. 7 is a block diagram showing a configuration of a microphone device using a noise extraction device, according to a fifth embodiment of the present invention.

FIG. 7 is a block diagram showing a configuration of a microphone device using the noise extraction device 300, according to the fifth embodiment. The components common to those in FIG. 6 are assigned the same numerals used in FIG. 6, and thus the detailed explanations are omitted here.

A microphone device 500 shown in FIG. 7 is different from the noise extraction device 400 of the fourth embodiment in that a signal delay unit 97, a signal amplification unit 98, and a signal subtraction unit 99 are newly included. The other components are the same as those in the fourth embodiment.

The first directivity synthesis unit 20 performs the addition-type directivity synthesis on an output signal um0 from the first microphone unit 11 and an output signal um1 from the second microphone unit 12, and then provides an output signal xm0. The second directivity synthesis unit 30 performs directivity synthesis of sound-pressure gradient type on the output signal um0 from the first microphone unit 11 and the output signal um1 from the second microphone unit 12, and then provides an output signal xm1. The third directivity synthesis unit 40 performs directivity synthesis of sound-pressure gradient type on the output signal um0 from the first microphone unit 11 and the output signal um1 from the second microphone unit 12, and then provides an output signal xm2.

Moreover, the first time-frequency transformation unit 51 transforms the output signal xm0 received from the first directivity synthesis unit 20, from the time domain to the frequency domain. Similarly, the second time-frequency transformation unit 52 transforms the output signal xm1 received from the second directivity synthesis unit 30, from the time domain to the frequency domain. The third time-frequency transformation unit 53 transforms the output signal xm2 received from the third directivity synthesis unit 40, from the time domain to the frequency domain.

The first signal absolute value calculation unit 71 calculates an absolute value of the output signal xm0 received from the first time-frequency transformation unit 51 for each frequency component, and then provides an output of the calculated absolute value. The second signal absolute value calculation unit 72 calculates an absolute value of the output signal xm1 received from the second time-frequency transformation unit 52 for each frequency component, and then provides an output of the calculated absolute value. The third signal absolute value calculation unit 73 calculates an absolute value of the output signal xm2 received from the third time-frequency transformation unit 53 for each frequency component, and then provides an output of the calculated absolute value.

The signal cancellation calculation unit 80 receives a first output signal |Xm0| from the first signal absolute value calculation unit 71, a second output signal |Xm1| from the second signal absolute value calculation unit 72, and a third output signal |Xm2| from the third signal absolute value calculation unit 73. The signal cancellation calculation unit 80 performs addition-subtraction processing on the first output signal |Xm0|, the second output signal |Xm1|, and the third output signal Xm2 to cancel acoustic signal components of a sound wave, and then provides an output signal Nv1, for example, which is a noise signal component of vibration noise.

The signal reconstruction unit 900 includes the signal phase extraction unit 93, the signal amplitude-phase synthesis unit 94, and the frequency-time transformation unit 95. The signal reconstruction unit 900 receives: the output signal Nv1 showing the vibration noise amplitude information that is received from by the signal cancellation calculation unit 80; and the output signal Xm2 from the third directivity synthesis unit 40, and then provides the output signal nv2.

To be more specific, the signal phase extraction unit 93 extracts a signal phase of the output signal Xm2 from the third directivity synthesis unit 40.

The signal amplitude-phase synthesis unit 94 performs multiplicative synthesis on the output signal Nv1 showing the amplitude spectrum information of the vibration noise that is received from the signal cancellation calculation unit 80 and the signal phase of the output signal Xm2 showing the spectrum of the directional output signal xm2. Then, the signal amplitude-phase synthesis unit 94 provides the output signal Nv2 showing the spectrum.

The frequency-time transformation unit 95 transforms the output signal Nv2 showing the spectrum that is received from the signal amplitude-phase synthesis unit 94 into a temporal signal which is then provided as the outputs signal nv2.

The signal delay unit 97 receives the output signal xm2 from the third directivity synthesis unit 40, and delays the received signal xm2 when providing an output of this signal.

The signal amplification unit 98 receives the output signal nv2 from the frequency-time transformation unit 95, and adjusts an output level of the received signal nv2 when providing an output of this signal.

The signal subtraction unit 99 receives the signal from the signal delay unit 97 and the output signal nv2 whose output level has been adjusted by the signal amplification unit 98. Then, the signal subtraction unit 99 performs subtraction on these received signals and provides an output.

The microphone device 500 is configured as described so far.

Next, an operation of the microphone device 500 is explained.

An explanation is given about the signal delay unit 97, the signal amplification unit 98, and the signal subtraction unit 99 shown in FIG. 7 that are not present in the fourth embodiment. The other components are the same as those in the fourth embodiment, and thus the explanations are omitted here.

The output signal nv2 showing the to-be-extracted vibration noise waveform that is provided by the signal reconstruction unit 900 is the vibration noise included in the directional output signal xm2 from the third directivity synthesis unit 40.

The output signal nv2 is delayed by a processing time for the time-frequency transformation and the frequency-time transformation performed using the FFTs (the first time-frequency transformation unit 51, the second time-frequency transformation unit 52, and the third time-frequency transformation unit 53) and the IFFT (the frequency-time transformation unit 95). Thus, the signal delay unit 97 delays the output signal xm2 from the third directivity synthesis unit 40, and performs time modification corresponding to the processing time.

The signal subtraction unit 99 executes the subtraction when the phases are aligned. As a result, the output signal from the signal subtraction unit 99 is an output from a directional microphone with the vibration noise being canceled (that is, a picked-up signal of the target sound wave).

It should be noted that since the output signal nv2 representing an estimated vibration-noise signal shows the amplitude twice as large as the vibration noise waveform included in xm2 as described above, the signal is amplified by half by the signal amplification unit 98.

As described so far, using the noise extraction device 500 according to the fifth embodiment, the output of the vibration noise entering into the microphone unit and the output of the acoustic signal of the sound wave can be separately provided, using the plurality of microphone units (the first microphone unit 11 and the second microphone unit 12) for sensing the target sound wave. Accordingly, a microphone device which includes a plurality of microphone units and has superior resistance to vibration can be realized. Moreover, the function of the microphone device as a vibration sensor can also be realized at the same time.

As described, according to the present invention, the directivity formation is performed using the outputs from the plurality of microphone units. The calculation result (the synthesized output signal of the directionally-synthesized output in the opposite direction, in particular) includes relatively more vibration components entering into the microphone device, and thus the result can also be used for detecting the vibration components. Accordingly, the plurality of microphone units included for the purpose of picking up the target sound wave can also be used as vibration sensors. In other words, according to the present invention, without additionally using a dedicated sensor, the vibration noise entering into the microphone device is extracted using the microphone device which is originally intended for picking up a sound wave, and the extracted vibration noise is removed. Accordingly, a microphone device which has superior resistance to vibration can be realized.

The above microphone device 500 is explained by showing its function structure.

Figure 8:
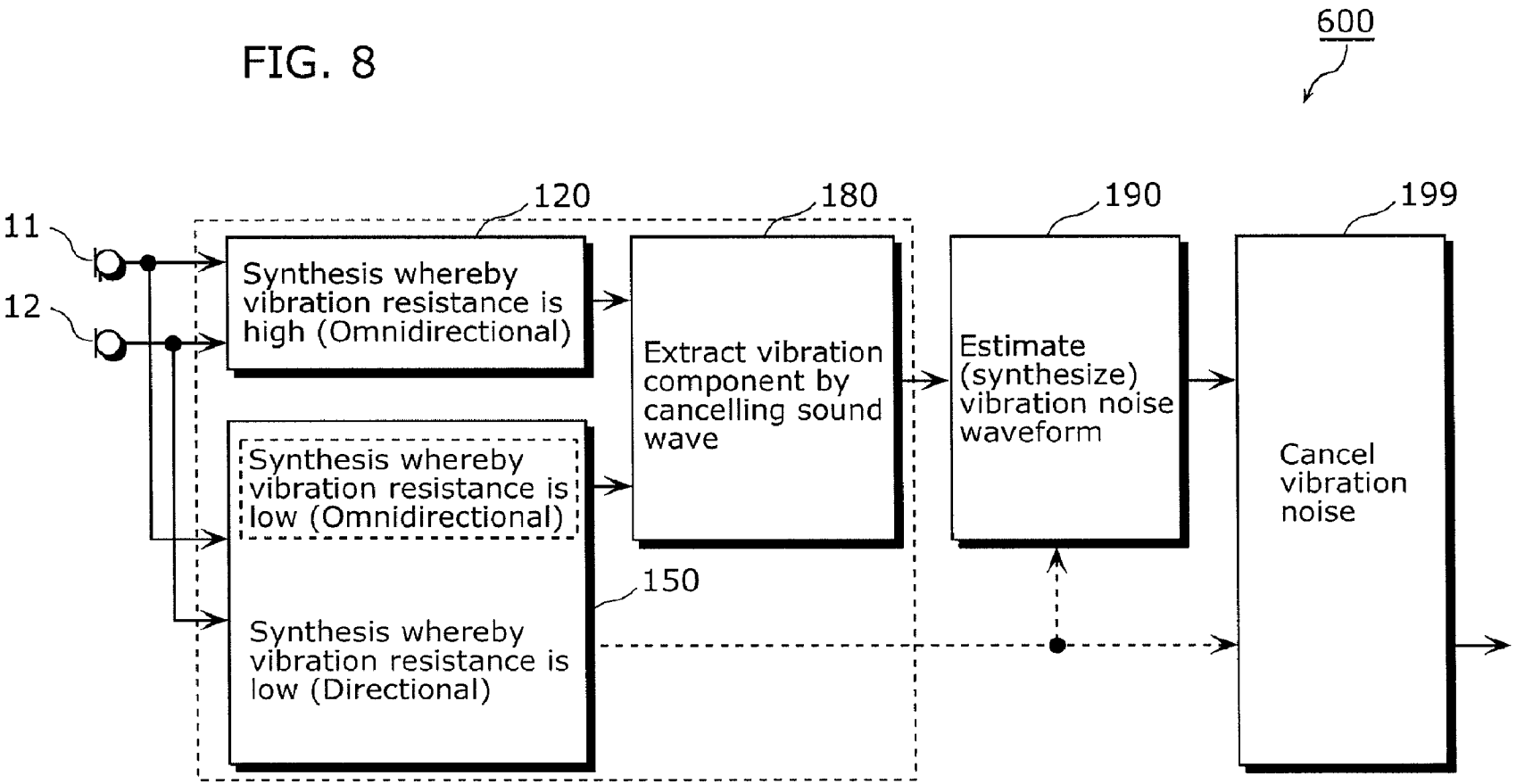
FIG. 8 is a block diagram showing a function structure of the microphone device, according to the fifth embodiment of the present invention.

FIG. 8 is a block diagram showing the function structure of the microphone device, according to the fifth embodiment of the present invention.

A microphone device 600 shown in FIG. 8 corresponds to the microphone device 500, and includes the first microphone unit 11 and the second microphone unit 12 for picking up a sound. The microphone unit 600 further includes directivity synthesis units 120 and 150, an acoustic cancellation unit 180, a signal reconstruction unit 190, and an acoustic output unit 199.

The directivity synthesis units 120 and 150 each perform a directivity synthesis on output signals respectively received from the first and second microphone units, and generate two directionally synthesized signals which have: different sensitivities to noise; the same directional pattern with respect to sound pressure; and the same effective acoustic center position. The directivity synthesis unit 120 performs synthesis so that resistance to vibration becomes high, and the directivity synthesis unit 150 performs synthesis so that resistance to vibration becomes low.

Moreover, the acoustic cancellation unit 180 cancels an acoustic component of one of the two directionally synthesized signals by subtracting the other of the two directionally synthesized signals from the one of the two directionally synthesized signals, so as to extract a noise component. The acoustic cancellation unit 180 provides the output signal showing the extracted noise component.

The signal reconstruction unit 190 reconstructs a noise waveform signal using the output signal from the acoustic cancellation unit 180 and the output signal from the directivity synthesis unit 120 or 150, and then provides an output of the reconstructed signal.

The acoustic output unit 199 subtracts the noise waveform signal extracted by the acoustic cancellation unit 180 and reconstructed by the signal reconstruction unit 190, from the output signal of the directivity synthesis unit 150, and then provides an output of a vibration-suppressed acoustic signal.

As described so far, the microphone device 600 can provide the output of the vibration-suppressed acoustic signal, namely, the output from a directional microphone with the vibration noise being canceled (that is, a picked-up signal of the target sound wave).

Accordingly, the present invention can realize a noise extraction device which extracts noise without newly adding a vibration sensor to a microphone device that picks up a sound wave.

In the first to fourth embodiments of the present invention, the explanation has been given about the case, as an example, where the subtraction unit is used as the simplest component for performing the processing to cancel vibration noise included in the directional output signal xm2 from the third directivity synthesis unit 40. However, a noise suppression unit of two-input type may be used, so that the processing is performed in a power spectrum domain, with xm2 being set as the main signal and nv2 being set as the reference signal, for example. Or, a canceller having an adaptive filter may be used.

Moreover, the units described in the first to fourth embodiments of the present invention may be realized when various kinds of computer programs previously held in the device are executed on a single processor or a plurality of processors serving as hardware.

Furthermore, the directional pattern of the synthesized output signal derived from the first output signal of the first directivity synthesis unit 20, the second output signal of the second directivity synthesis unit 30, and the third output signal of the third directivity synthesis unit 40 is not limited to forming directivity relative to a particular one direction, and thus may form omni-directivity as long as the patterns are the same and a relative ratio of the vibration level included in the synthesized signal with respect to the acoustic signal level is larger than a relative ratio of the vibration level included in the first output signal with respect to the acoustic signal level.

Other Modifications

Although the present invention has been explained on the basis of the above embodiments and modifications, it should be understood that the present invention is not limited to the above embodiments. The present invention includes the following cases as well.

(1) The above-described processing units (such as the directivity synthesis units, the signal absolute value calculation units, and the signal cancellation calculation unit) except for the microphone units are implemented as a computer system configured by a microprocessor, a ROM, a RAM, and the like, to be more precise. The RAM stores computer programs.

When the microprocessor operates according to the computer programs, each device and each component achieve their functions. Here, a computer program is structured by a combination of instruction codes showing instructions to be given to a computer in order for a specified function to be achieved.

(2) Some or all of the components included in each of the above-described devices may be constructed by a single system LSI (Large Scale Integration: large scale integrated circuit).

The system LSI is an ultra multi-function LSI manufactured by integrating a plurality of components on a single chip, To be more specific, it is a computer system configured to include a microprocessor, a ROM, a RAM, and the like. The RAM stores computer programs.

When the microcomputer operates according to the computer programs, the system LSI achieves its function.

(3) Some or all of the components included in each of the above-described devices may be constructed by an IC card which can be inserted or removed into or from the device, or by a single module.

The IC card or the module is a computer system configured by a microprocessor, a ROM, a RAM, and the like. The IC card or the module may include the above-mentioned ultra multi-function LSI.

When the microcomputer operates according to the computer programs, the IC card or the module achieves its function. The IC card or the module may have tamper resistance.

(4) The present invention may be the methods described above. Alternatively, the present invention may be a computer program realizing these methods using a computer, or a digital signal structured by the computer program.

Moreover, the present invention as the computer program or the digital signal may be recorded into a computer-readable record medium, such as a flexible disk, a hard disk, a CD-ROM, an MO, a DVD, DVD-ROM, a DVD-RAM, a BD (Blu-ray Disc), or a semiconductor memory. Or, the present invention may be digital signals stored in these record media.

Furthermore, the present invention may transmit the computer program or the digital signal via a telecommunication line, a wireless or wire communication line, a network typified by the Internet, or a data broadcast.

Also, the present invention may be a computer system including a microprocessor and a memory, the memory storing a computer program and the microprocessor operating according to the computer program.

Moreover, by recording the program or the digital signal into a record medium and then transporting the record medium, or by transporting the program or the digital signal via a network or the like, the present invention may be carried out by a separate stand-alone computer system.

(5) The present invention may be constructed by a combination of the above-described embodiments and the above-described modifications.

INDUSTRIAL APPLICABILITY

The present invention can be used not only as the vibration noise extraction device or the noise extraction device such as the wind noise extraction device, but also as the microphone device which has superior resistance to vibration and superior resistance to wind noise.

Figure 9:
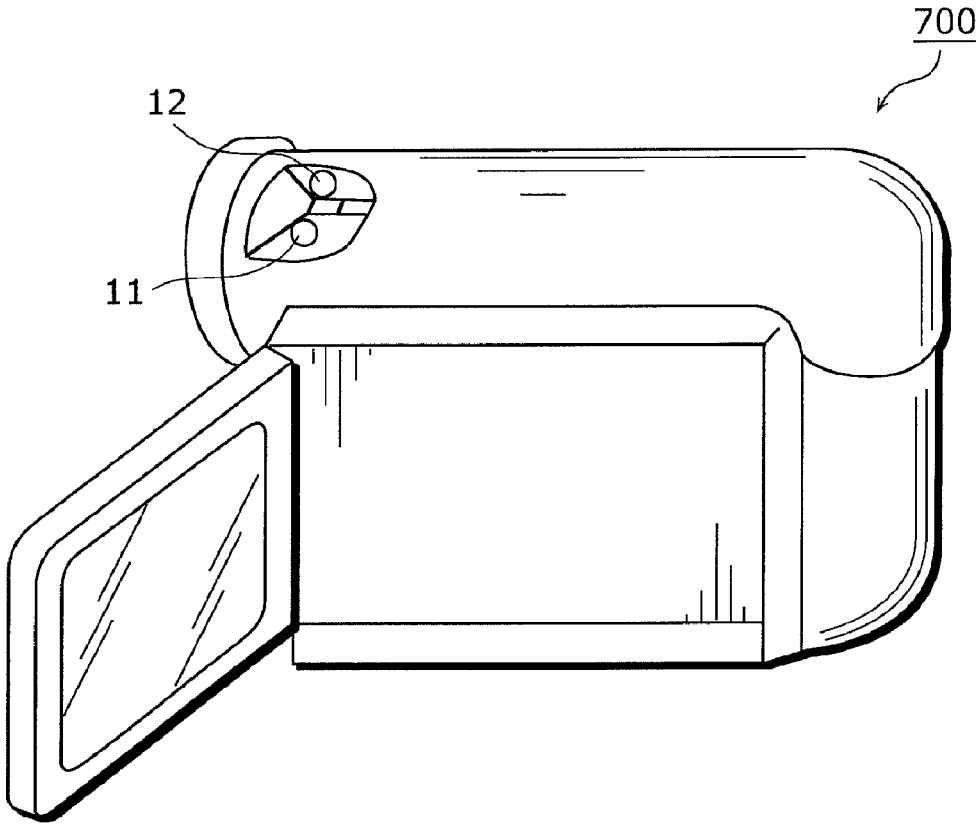
FIG. 9 is a diagram showing an example of an application where the microphone device of the present invention can be used.
Figure 10:
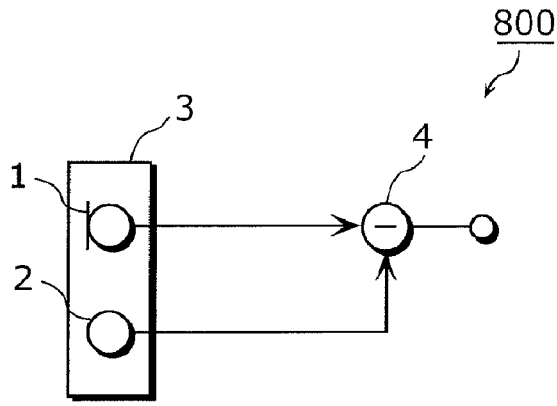
FIG. 10 is a diagram for explaining a conventional method for addressing vibration noise.

Especially, when the microphone device using directional microphones serves as the vibration noise extraction device and the wind noise extraction device, the present invention can be used as the microphone device which has superior resistance to vibration and to wind noise as in a video camera 700 shown in FIG. 9. Moreover, in the case of the method for picking up a sound by obtaining an output through the signal synthesis using signals from a plurality of microphones, the present invention can be used as the microphone device which suppresses the increase in vibration noise and in wind noise and has superior resistance to vibration and to wind noise. On account of this, aside from a common microphone, the present invention can be applied to a device, such as a mike-speaker all-in-one system of a wearable device, a camcorder, or an internal microphone of a device having moving parts, in which vibration noise and wind noise become problems.

Since only vibration can be accurately detected from a signal of a microphone, the present invention can be used as a vibration sensor or a compound sensor.

The invention claimed is:

1. A noise extraction device, comprising:

first and second microphone units respectively located at spatially different positions and each configured to pick up a sound;

a directivity synthesis unit configured to perform a directivity synthesis on output signals respectively received from said first and second microphone units, and generate two directionally synthesized signals which have: different sensitivities to noise; a same directional pattern with respect to sound pressure; and a same effective acoustic center position; and an acoustic cancellation unit configured to extract a noise component by cancelling an acoustic component of one of the two directionally synthesized signals by subtracting the one of the two directionally synthesized signals from another of the two directionally synthesized signals, wherein said directivity synthesis unit includes first, second, and third directivity synthesis units, each configured to perform the directivity synthesis on the output signals respectively received from said first and second microphone units, and wherein said acoustic cancellation unit includes a cancellation calculation unit configured to obtain the one of the two directionally synthesized signals from an output signal provided by said first directivity synthesis unit, generate the other of the two directionally synthesized signals using output signals respectively provided by said second and third directivity synthesis units, and cancel the acoustic component by subtracting the one of the two directionally synthesized signals from the other of the two directionally synthesized signals.

2. The noise extraction device according to claim 1, wherein said directivity synthesis unit further includes first, second, and third signal absolute value units configured to respectively calculate absolute values of the output signals received from said first, second, and third directivity synthesis units and respectively provide outputs of absolute value signals.

3. The noise extraction device according to claim 2, wherein as compared to said first directivity synthesis unit, each of said second and third directivity synthesis units has one of: a high sensitivity to the noise component; and a low sensitivity to the acoustic component.

4. The noise extraction device according to claim 2, wherein said second and third directivity synthesis units are configured to respectively perform the directivity syntheses so that directional patterns of the output signals of said second and third directivity synthesis units become opposite in direction to each other, according to a directivity synthesis method of a sound-pressure gradient type, and wherein a sum of the directional patterns of the output signals respectively output from said second and third directivity synthesis units is equivalent to a directional pattern of the output signal output from said first directivity synthesis unit.

5. The noise extraction device according to claim 2, wherein said first directivity synthesis unit is configured to perform the directivity synthesis of an addition type by adding the output signals from said first and second microphone units together, wherein said second directivity synthesis unit is configured to perform the directivity synthesis of a sound-pressure gradient type by causing a predetermined delay to the output signal of said second microphone unit and subtracting the delayed output signal from the output signal of said first microphone unit, and wherein said third directivity synthesis unit is configured to perform the directivity synthesis of the sound-pressure gradient type by causing a predetermined delay to the output signal of said first microphone unit and subtracting the delayed output signal from the output signal of said second microphone unit.

6. The noise extraction device according to claim 2, further comprising first, second, and third signal band limitation units configured to respectively limit signal bands of the output signals output from said first, second, and third directivity synthesis units, and provide the band-limited output signals to said first, second, and third signal absolute value units respectively.

7. The noise extraction device according to claim 2, wherein said acoustic cancellation unit is configured to provide an output signal showing the extracted noise component, and wherein said noise extraction device further comprises a signal reconstruction unit configured to reconstruct a noise waveform signal using the output signal output from said acoustic cancellation unit and the output signal output from one of said first, second, and third directivity synthesis units, and provide an output of the reconstructed noise waveform signal.

8. The noise extraction device according to claim 7, wherein said signal reconstruction unit is configured to reconstruct the noise waveform signal by multiplying the output signal output from said cancellation calculation unit by a sign of the output signal output from one of said first, second, and third directivity synthesis units.

9. The noise extraction device according to claim 2, further comprising time-frequency transformation units configured to perform a transformation from a time domain to a frequency domain, said time-frequency transformation units being respectively located before or after said first, second, and third directivity synthesis units, wherein said cancellation calculation unit is configured to extract the noise component for each frequency of the frequency domain.

10. The noise extraction device according to claim 9, further comprising a signal reconstruction unit configured to reconstruct a noise waveform signal using the output signal output from said cancellation calculation unit and the output signal output from one of said first, second, and third directivity synthesis units, and provide an output of the reconstructed noise waveform signal, wherein said signal reconstruction unit is configured to reconstruct the noise waveform signal using phase information for each frequency of the output signal output from one of said first, second, and third directivity synthesis units and amplitude information for each frequency of the output signal output from said cancellation calculation unit.

11. The noise extraction device according to claim 1, wherein said noise extraction device is a vibration sensor.

12. The noise extraction device according to claim 11, wherein said noise extraction device is configured to extract the acoustic component from the one of the two directionally synthesized signals.

13. A microphone device, comprising:

a noise extraction device comprising:

first and second microphone units respectively located at spatially different positions and each configured to pick UP a sound;

a directivity synthesis unit configured to perform a directivity synthesis on output signals respectively received from said first and second microphone units, and generate two directionally synthesized signals which have: different sensitivities to noise; a same directional pattern with respect to sound pressure; and a same effective acoustic center position; and an acoustic cancellation unit configured to extract a noise component by cancelling an acoustic component of one of the two directionally synthesized signals by subtracting the one of the two directionally synthesized signals from another of the two directionally synthesized signals, wherein said directivity synthesis unit includes first, second, and third directivity synthesis units, each configured to perform the directivity synthesis on the output signals respectively received from said first and second microphone units, and wherein said acoustic cancellation unit includes a cancellation calculation unit configured to obtain the one of the two directionally synthesized signals from an output signal provided by said first directivity synthesis unit, generate the other of the two directionally synthesized signals using output signals respectively provided by said second and third directivity synthesis units, and cancel the acoustic component by subtracting the one of the two directionally synthesized signals from the other of the two directionally synthesized signals; and an acoustic output unit configured to provide an output of a noise-suppressed acoustic signal by subtracting the noise signal component extracted by said noise extraction device from the output signals output from said first and second microphone units.

14. A noise extraction method for a noise extraction device which includes first and second microphone units respectively located at spatially different positions and each configured to pick up a sound, said noise extraction method comprising:

performing, via a directivity synthesis unit, a directivity synthesis on output signals respectively received from the first and second microphone units to generate two directionally synthesized signals which have: different sensitivities to noise; a same directional pattern with respect to sound pressure; a same effective acoustic center position; and extracting, via an acoustic cancellation unit, a noise component by cancelling an acoustic component of one of the two directionally synthesized signals by subtracting the one of the two directionally synthesized signals from another of the two directionally synthesized signals, wherein the directivity synthesis unit includes first, second, and third directivity synthesis units, wherein said performing includes performing, via each respective first, second and third directive synthesis units, the directivity synthesis on the output signals respectively received from the first and second microphone units, wherein the acoustic cancellation unit includes a cancellation calculation unit, and wherein said extracting includes (i) obtaining, via the cancellation calculation unit, the one of the two directionally synthesized signals from an output signal provided by the first directivity synthesis unit, so as to generate the other of the two directionally synthesized signals using output signals respectively provided by the second and third directivity synthesis units, and (ii) cancelling, via the cancellation calculation unit, the acoustic component by subtracting the one of the two directionally synthesized signals from the other of the two directionally synthesized signals.

15. An integrated circuit which includes first and second microphone units respectively located at spatially different positions and each configured to pick up a sound and extract a noise component, said integrated circuit comprising:

a directivity synthesis unit configured to perform a directivity synthesis on output signals respectively received from said first and second microphone units, and generate two directionally synthesized signals which have: different sensitivities to noise; a same directional pattern with respect to sound pressure; and a same effective acoustic center position; and an acoustic cancellation unit configured to extract a noise component by cancelling an acoustic component of one of the two directionally synthesized signals by subtracting the one of the two directionally synthesized signals from another of the two directionally synthesized signals, wherein said directivity synthesis unit includes first, second, and third directivity synthesis units, each configured to perform the directivity synthesis on the output signals respectively received from said first and second microphone units, and wherein said acoustic cancellation unit includes a cancellation calculation unit configured to obtain the one of the two directionally synthesized signals from an output signal provided by said first directivity synthesis unit, generate the other of the two directionally synthesized signals using output signals respectively provided by said second and third directivity synthesis units, and cancel the acoustic component by subtracting the one of the two directionally synthesized signals from the other of the two directionally synthesized signals.

16. A video camera, comprising:

a microphone device; and a camera unit configured to take an image of a target object, wherein the microphone device comprises:

a noise extraction device including:

first and second microphone units respectively located at spatially different positions and each configured to pick UP a sound;

a directivity synthesis unit configured to perform a directivity synthesis on output signals respectively received from said first and second microphone units, and generate two directionally synthesized signals which have: different sensitivities to noise; a same directional pattern with respect to sound pressure; and a same effective acoustic center position; and an acoustic cancellation unit configured to extract a noise component by cancelling an acoustic component of one of the two directionally synthesized signals by subtracting the one of the two directionally synthesized signals from another of the two directionally synthesized signals, wherein said directivity synthesis unit includes first, second, and third directivity synthesis units, each configured to perform the directivity synthesis on the output signals respectively received from said first and second microphone units, and wherein said acoustic cancellation unit includes a cancellation calculation unit configured to obtain the one of the two directionally synthesized signals from an output signal provided by said first directivity synthesis unit, generate the other of the two directionally synthesized signals using output signals respectively provided by said second and third directivity synthesis units, and cancel the acoustic component by subtracting the one of the two directionally synthesized signals from the other of the two directionally synthesized signals; and an acoustic output unit configured to provide an output of a noise-suppressed acoustic signal by subtracting the noise signal component extracted by said noise extraction device from the output signals output from said first and second microphone units.

* * * * *